US012515095B2

(12) United States Patent
Bayerlein et al.

(10) Patent No.: US 12,515,095 B2
(45) **Date of Patent: *Jan. 6, 2026**

(54) HANDRAIL CONFIGURATION FOR A TREADMILL

(71) Applicant: Woodway USA, Inc., Waukesha, WI (US)

(72) Inventors: Douglas G. Bayerlein, Oconomowoc, WI (US); Nicholas A. Oblamski, Waukesha, WI (US); Jose D. Bernal-Ramirez, West Allis, WI (US); Joseph Martin, Pewaukee, WI (US)

(73) Assignee: Woodway USA, Inc., Waukesha, WI (US)

( * ) Notice: Subject to any disclaimer, the term of this patent is extended or adjusted under 35 U.S.C. 154(b) by 196 days.

This patent is subject to a terminal disclaimer.

(21) Appl. No.: 18/242,449

(22) Filed: Sep. 5, 2023

(65) Prior Publication Data

US 2023/0414993 A1 Dec. 28, 2023

Related U.S. Application Data

(63) Continuation of application No. 17/379,318, filed on Jul. 19, 2021, now Pat. No. 11,779,801, which is a (Continued)

(51) Int. Cl.
*A63B 22/02* (2006.01)
*A63B 23/04* (2006.01)

(Continued)

(52) U.S. Cl.
CPC ..... *A63B 22/0285* (2013.01); *A63B 23/04* (2013.01); *A63B 2022/0271* (2013.01);

(Continued)

(58) Field of Classification Search
CPC . A63B 22/0285; A63B 23/04; A63B 23/1227; A63B 24/0062; A63B 71/0619;

(Continued)

(56) References Cited

U.S. PATENT DOCUMENTS 5,171,196 A 12/1992 Lynch
D429,783 S 8/2000 Cray et al.

(Continued)

FOREIGN PATENT DOCUMENTS

CN 3526989.8 5/2006
CN 3586969.0 12/2006

(Continued)

OTHER PUBLICATIONS

Extended European Search Report for Application No. EP 18751407.0 mailing date May 6, 2021, 12 pages.

(Continued)

*Primary Examiner* — Andrew S Lo
(74) *Attorney, Agent, or Firm* — Foley & Lardner LLP

(57) ABSTRACT

A treadmill is provided. The treadmill includes a frame; a first side support coupled to and extending substantially vertically upwards relative to the frame; a second side support coupled to and extending substantially vertically upwards relative to the frame; and a handrail assembly having a first side coupled to the first side support and a second side coupled to the second side support, each of the first and second sides of the handrail assembly comprising upper and lower members vertically spaced from one another and front and rear push members spaced apart from one another along a longitudinal length of the treadmill, the front and rear push members coupling the upper and lower members, and collectively providing a plurality of hand placement positions including at least two substantially (Continued)

horizontally aligned hand placement positions and at least one primarily vertically aligned hand placement position.

20 Claims, 18 Drawing Sheets

Related U.S. Application Data continuation of application No. 16/485,341, filed as application No. PCT/US2018/017777 on Feb. 12, 2018, now Pat. No. 11,065,503.

(60) Provisional application No. 62/458,178, filed on Feb. 13, 2017.

(51) Int. Cl.
*A63B 23/12* (2006.01)
*A63B 24/00* (2006.01)
*A63B 71/06* (2006.01)

(52) U.S. Cl.
CPC ..... *A63B 23/1227* (2013.01); *A63B 24/0062* (2013.01); *A63B 71/0619* (2013.01)

(58) Field of Classification Search
CPC ..... A63B 2022/0271; A63B 24/00; A63B 23/0405; A63B 22/02–0264
USPC ..... D21/662–696
See application file for complete search history.

(56) References Cited

U.S. PATENT DOCUMENTS

| | | | |
|---|---|---|---|
| D445,152 | S | 7/2001 | Wang et al. |
| 6,743,153 | B2 | 6/2004 | Watterson et al. |
| 6,824,502 | B1 | 11/2004 | Huang |
| 6,878,099 | B2 | 4/2005 | Corbalis et al. |
| 6,899,659 | B2 | 5/2005 | Anderson et al. |
| 7,086,995 | B2 | 8/2006 | Reyes et al. |
| 7,179,202 | B2 | 2/2007 | Marin et al. |
| 7,179,204 | B2 | 2/2007 | Anderson et al. |
| D557,360 | S | 12/2007 | Olason et al. |
| 7,303,508 | B2 | 12/2007 | Toyama et al. |
| 7,481,744 | B2 | 1/2009 | Reyes et al. |
| 7,537,549 | B2 | 5/2009 | Nelson et al. |
| 7,544,152 | B2 | 6/2009 | Dey et al. |
| 7,618,345 | B2 | 11/2009 | Corbalis et al. |
| 7,645,214 | B2 | 1/2010 | Lull |
| 7,736,280 | B2 | 6/2010 | Weier et al. |
| D625,372 | S | 10/2010 | Foley et al. |
| 7,862,483 | B2 | 1/2011 | Hendrickson et al. |
| D657,833 | S | 4/2012 | Cloutier |
| 8,454,480 | B2 | 6/2013 | Molter et al. |
| 8,920,288 | B2 | 12/2014 | Dalebout et al. |
| 8,926,479 | B2 | 1/2015 | Chen et al. |
| D763,976 | S | 8/2016 | Vezeau et al. |
| 10,335,632 | B2 | 7/2019 | Baker |
| 10,398,932 | B2 | 9/2019 | Hamilton et al. |
| 10,569,152 | B2 | 2/2020 | Fima |
| 2005/0209060 | A1 | 9/2005 | Lull |
| 2006/0035757 | A1 | 2/2006 | Flick et al. |
| 2006/0124466 | A1 | 6/2006 | Xu et al. |
| 2007/0049466 | A1 | 3/2007 | Hubbard |
| 2008/0287816 | A1 | 11/2008 | Honda |
| 2009/0118103 | A1 | 5/2009 | Ellis |
| 2009/0156363 | A1 | 6/2009 | Guidi et al. |
| 2009/0163327 | A1 | 6/2009 | Huang et al. |
| 2011/0082013 | A1 | 4/2011 | Bastian |
| 2011/0152039 | A1 | 6/2011 | Hendrickson et al. |
| 2014/0100085 | A1 | 4/2014 | Hao |
| 2014/0235410 | A1 | 8/2014 | Lee |
| 2016/0023039 | A1 | 1/2016 | Cei |
| 2016/0023049 | A1 | 1/2016 | Dalebout |
| 2016/0059078 | A1 | 3/2016 | Liao |
| 2017/0128769 | A1 | 5/2017 | Long et al. |
| 2017/0189745 | A1 | 7/2017 | Hamilton et al. |
| 2017/0225023 | A1 | 8/2017 | Crist et al. |
| 2018/0140903 | A1 | 5/2018 | Poure et al. |
| 2018/0250552 | A1 | 9/2018 | Liao et al. |
| 2019/0321680 | A1 | 10/2019 | Manzke et al. |
| 2019/0366149 | A1 | 12/2019 | Crist et al. |
| 2020/0316431 | A1 | 10/2020 | Corbalis |

FOREIGN PATENT DOCUMENTS

| | | | |
|---|---|---|---|
| CN | 301472005.6 | | 2/2011 |
| CN | 102728025 | B | 11/2014 |
| DE | 10 2013 112 582 | A1 | 5/2015 |
| EP | 1 415 685 | A1 | 6/2004 |

OTHER PUBLICATIONS

International Search Report and Written Opinion for International Application No. PCT/US2018/017777, mail date Apr. 30, 2018, 11 pages.

Partial Supplementary European Search Report on European Application No. 18751407.0, mail date Feb. 4, 2021, 13 pages.

Technogym, "Skillmill Connect", Feb. 7, 2016, https://web.archive.org/web/20160207113519/http://wwww.technogym.com:80/us/skillmill-connect.html, 2 pages.

HANDRAIL CONFIGURATION FOR A TREADMILL

CROSS-REFERENCE TO RELATED PATENT APPLICATIONS

This application is a continuation of U.S. application Ser. No. 17/379,318, titled "HANDRAIL CONFIGURATION FOR A TREADMILL," filed Jul. 19, 2021, which is a continuation of U.S. application Ser. No. 16/485,341, titled "HANDRAIL CONFIGURATION FOR A TREADMILL," filed Aug. 12, 2019, which is a U.S. national stage application of International Patent Application No. PCT/US2018/017777, titled "HANDRAIL CONFIGURATION FOR A TREADMILL," filed Feb. 12, 2018, which claims the benefit of and priority to U.S. Provisional Patent Application No. 62/458,178, entitled "HANDRAIL CONFIGURATION FOR A TREADMILL," filed Feb. 13, 2017, all of which are incorporated herein by reference in their entireties. This application is related to U.S. patent application Ser. No. 15/640,180, entitled "MOTORIZED TREADMILL WITH MOTOR BRAKING MECHANISM AND METHODS OF OPERATING THE SAME," filed Jun. 30, 2017, which is incorporated herein by reference in its entirety.

TECHNICAL FIELD

The present disclosure relates to treadmills. More particularly, the present disclosure relates to handrail configurations suitable for use with treadmills.

BACKGROUND

Treadmills enable a person to walk, jog, or run for a relatively long distance in a limited space. Treadmills can be used for physical fitness, athlete training and therapeutic uses for the treatment of medical conditions. It should be noted that throughout this document, the term "run" and variations thereof (e.g., running, etc.) in any context is intended to include all substantially linear locomotion by a person. Examples of this linear locomotion include, but are not limited to, jogging, walking, skipping, scampering, sprinting, dashing, hopping, galloping, side stepping, shuffling etc. The bulk of the discussion herein is focused on training and physical fitness, but persons skilled in the art will understand that all of the structures and methods described herein are equally applicable in medical therapeutic applications.

A person running generates force to propel themselves in a desired direction. To simplify this discussion, the desired direction will be designated as the forward direction. As the person's feet contact the ground (or other surface), their muscles contract and extend to apply a force to the ground that is directed generally rearward (i.e., has a vector direction substantially opposite the direction they desire to move). Keeping with Newton's third law of motion, the ground resists this rearwardly directed force from the person, resulting in the person moving forward relative to the ground at a speed related to the force they are creating. While the prior discussion relates solely to movement in the forward direction, persons skilled in the art will understand that this can mean movement in any direction, for example side to side, backward/reverse, any desired direction.

To counteract the force created by the treadmill user so that the user stays in a relatively static fore and aft position on the treadmill, a running belt of a treadmill is driven or rotated (e.g., by a motor). Thus, in operation, the running belt moves at substantially the same speed as the user, but in the opposite direction. In this way, the user remains in substantially the same relative position along the treadmill while running. However, many users may want to engage in different exercises and therapeutic programs than provided by conventional treadmills.

SUMMARY

One embodiment relates to a handrail assembly for a treadmill. The handrail assembly includes: a base having a first side and a second side; a first portion extending from the first side of the base; a second portion extending from the second side of the base; and a member coupled to the first portion and the second portion, the member including at least one lower section and at least one upper section. The base defines at least one compartment. At least a part of the member is configured to receive a pushing force from a user during use of the treadmill.

Another embodiment relates to a grip assembly for a treadmill. The grip assembly includes a base having a first side and a second side, and a member extending from the first side of the base to the second side of the base. The member includes: a first lower section coupled to and extending substantially inward towards a longitudinal center portion of the treadmill and away from the first side of the base; a second lower section coupled to and extending substantially inward towards the longitudinal center portion of the treadmill and away from the second side of the base; a first vertical section coupled to and extending at an angle substantially upwards from the first lower section; a second vertical section coupled to and extending at an angle substantially upwards from the first second section; and an upper section coupled to the first and second vertical sections.

Still another embodiment relates to a treadmill. The treadmill includes a frame; a first side support coupled to and extending vertically upwards from the frame; a second side support coupled to and extending vertically upwards from the frame; a first upper member coupled to the first side support; a first lower member coupled to the first side support, the first lower member being coupled to the first side support vertically below the first upper member; a second upper member coupled to the second side support; and a second lower member coupled to the second side support, the second lower member being coupled to the second side support vertically below the second upper member. The first upper member and the first lower member define a first space. The second upper member and the second lower member define a second space. Beneficially, the first and second spaces enable a user to reach through those spaces and grab at least one of the first and second upper and lower members. Further, the first and second upper and lower members may accommodate not only a wide variety of exercise and therapeutic programs, but users of various sizes.

BRIEF DESCRIPTION OF THE FIGURES

The accompanying drawings, which are incorporated and constitute a part of this specification, illustrate several embodiments that, together with the description, serve to explain the principles and features of the present disclosure.

DETAILED DESCRIPTION

Before turning to the Figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the Figures generally, a handrail configuration for a treadmill is disclosed according to various embodiments herein. According to the present disclosure, a treadmill includes a handrail and a display coupled to the handrail and the handrail includes push bar, a rear lower bar, a display position, and various other components. Applicant has determined that when using the push bar, a relatively larger angle relative to a vertical axis will cause both a horizontal and a vertical force to be applied to the wrist of a user, and in turn increase the overall force experienced by the user during exercises utilizing the push bar (e.g., a sled-type pushing exercise or therapeutic workout). However, by decreasing this angle, the overall force can be decreased. Further, when using the rear lower bar, a deviation from a horizontal axis causes additional force to be experienced by the wrist of a user when performing exercises that use this rear lower bar. In addition, the deviation from this horizontal axis can cause changes in the natural position of the body of the user when performing the exercises, which may cause a decrease in the effectiveness or proper form of the exercise as the user compensates for the deviation. Therefore, Applicant has determine a handrail configuration that may provide enhanced benefits relative to conventional handrail structure.

Further, Applicant has also determined a structure that provides a desired location for a display device of the treadmill while performing a multitude of exercises, which are described herein (e.g., sled exercises, etc.). A human eye has approximately a 120 degree vertical field of vision. Objects outside of this range of eye rotation will likely cause a user to rotate their head to view the object. Therefore, when the display of a treadmill is outside this range of eye rotation, head rotations will likely occur, causing modification and degradation of the user's form, which could result in injury. Beneficially, Applicant has tailored the placement of the display to accommodate typical treadmill uses (e.g., walking, running, jogging) as well as non-typically treadmill uses disclosed and described herein (e.g., pushing-type exercises, etc.).

Figure 1:
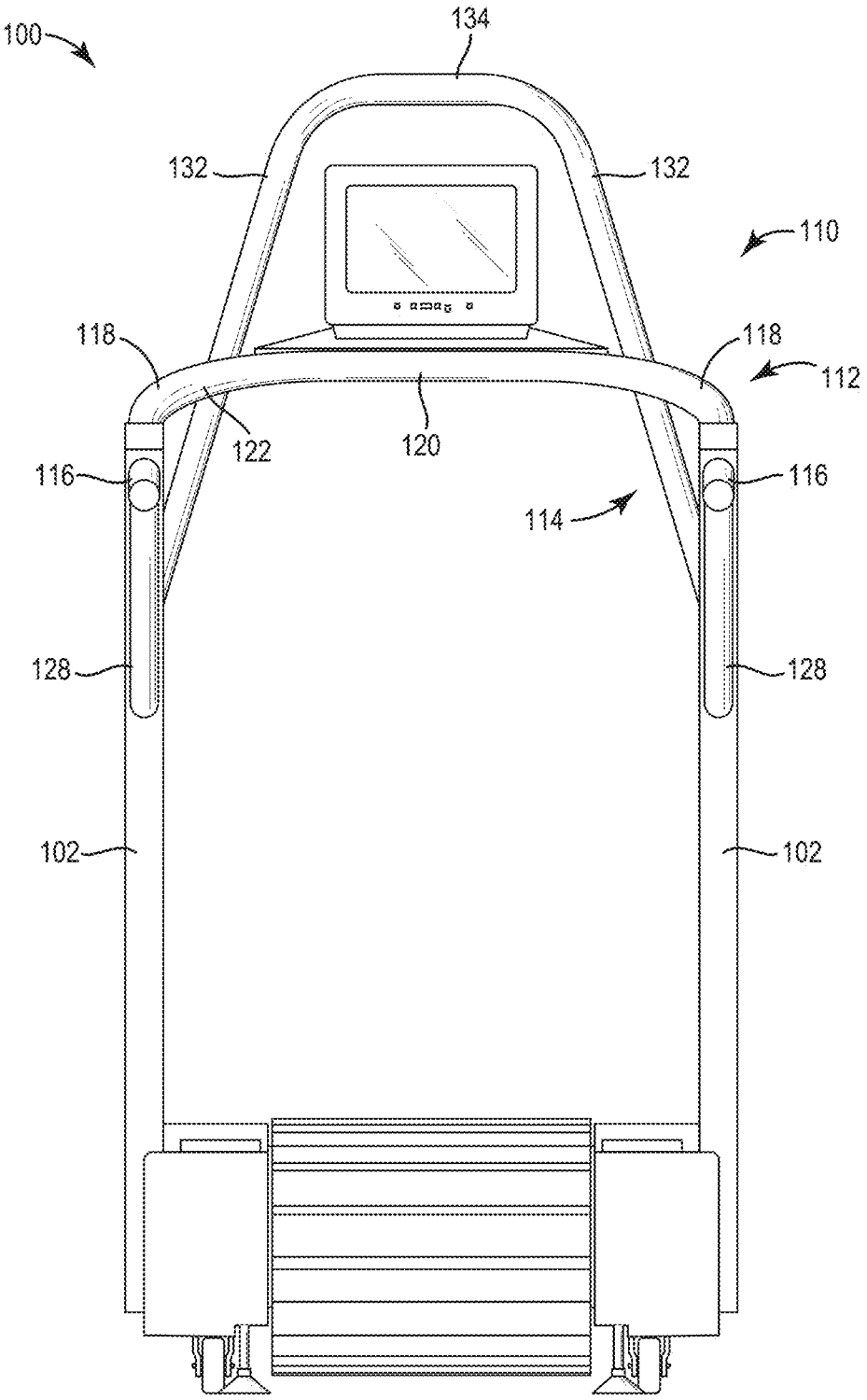
FIG. 1 is a back view of a treadmill with handrails, according to an exemplary embodiment.
Figure 2:
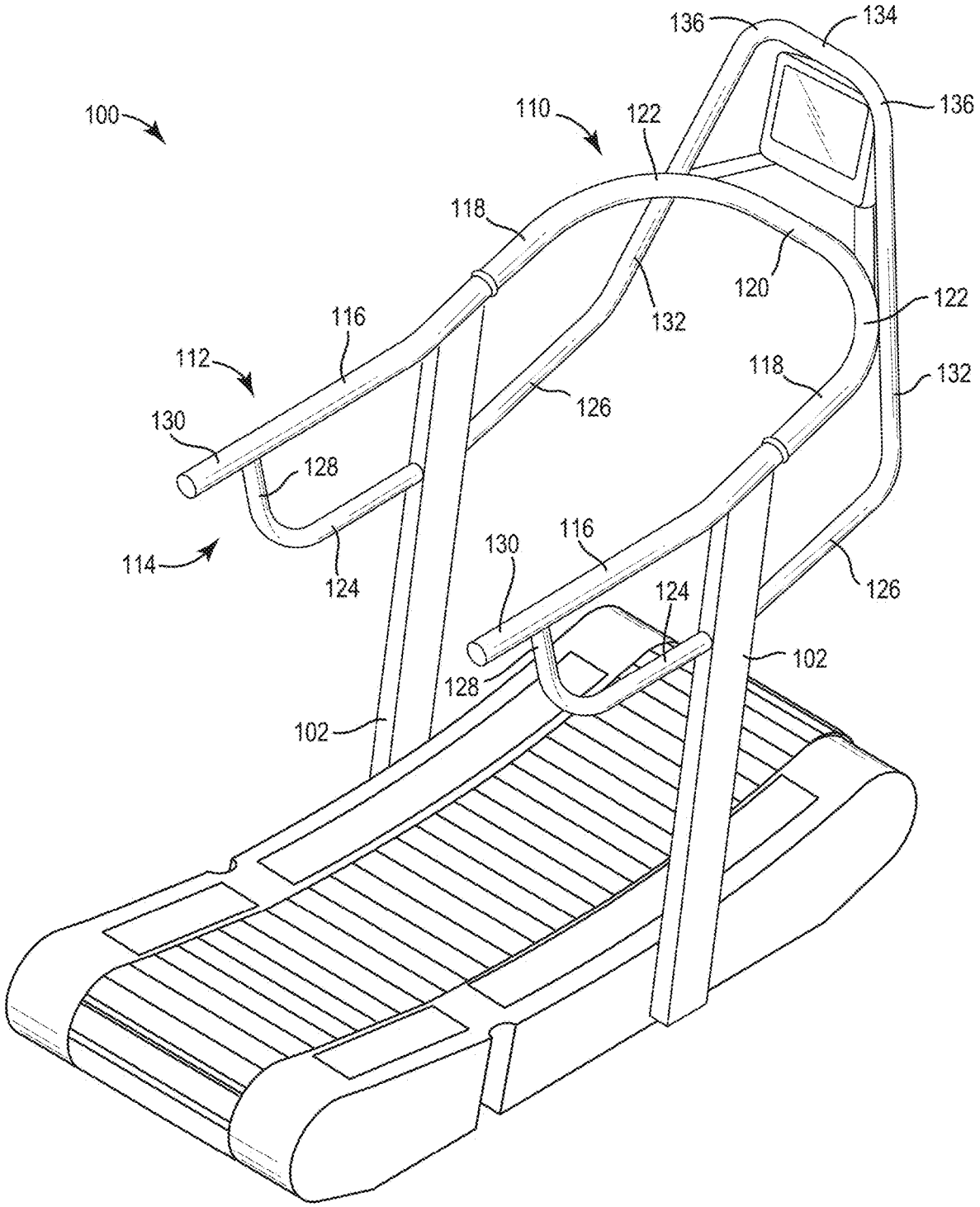
FIG. 2 is a perspective view of the treadmill with the handrails of FIG. 1, according to an exemplary embodiment.
Figure 3:
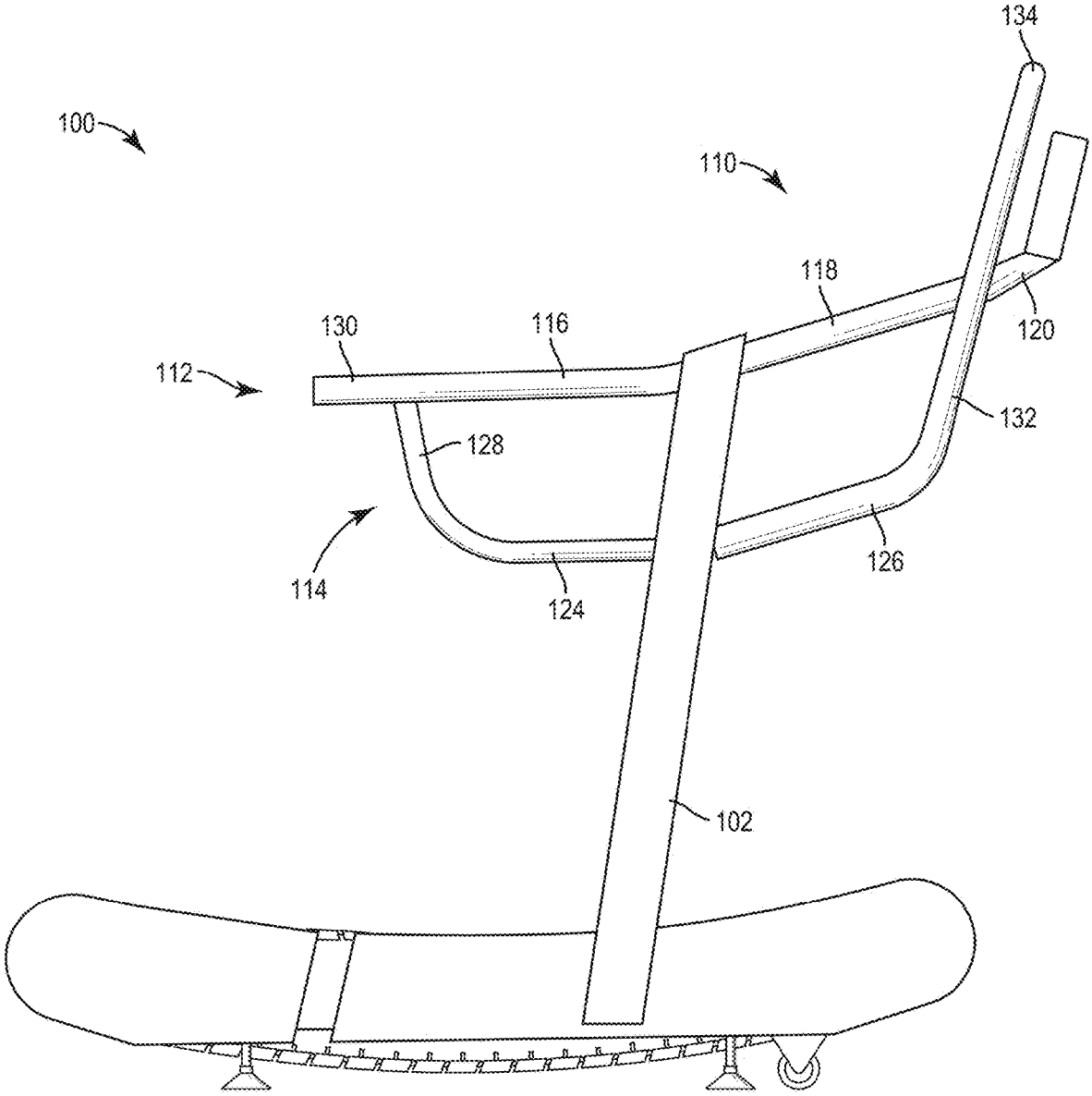
FIG. 3 is a side view of the treadmill with the handrails of FIG. 1, according to an exemplary embodiment.

Referring now to FIGS. 1-3, a treadmill 100 with handrails 110 is shown, according to an exemplary embodiment. The treadmill 100 may be treadmill 10 or treadmill 200, or substantially similar to treadmill 10 or treadmill 200, as described in U.S. patent application Ser. No. 15/640,180. Accordingly, treadmill 100 may have a planar running surface or a non-planar running surface. However, handrails 110 may be used with any treadmill configuration and should not be considered limited to treadmills 10 and 200. In the example depicted, the treadmill 100 has a similar configuration to the treadmill 10, such that reference may be made to the treadmill 10 in explanation of one or more components herein. For reference purposes and to ease explanation, as used herein when referring to a relative position of a component or where that component extends towards/from, the term "front" refers to locations or positions proximate to the display of the treadmill 100 while the term "rear" or "back" refers to locations or positions away from the display of the treadmill 100.

As shown, the handrails 110 (also referred to herein as the "handrail" and the "support structure") include supports 102 (also referred to as first side support and second side support), upper rails 112 (also referred to as a first and second upper bars or first and second upper members) coupled to the supports 102, lower rails 114 (also referred to as a first and second lower bars or first and second lower members) coupled to the supports 102, push bars or push members 132 coupled to the lower rails 114, and a top bar 134 or top member 134 (among other components). As shown, the supports 102 include a left side support and a right side support (also referred to as a first side support and a second side support); however, each of the left and right side supports are identical in configuration, such that they are collectively referred to as the supports 102. A first space is formed on a first side of the device between the first upper rail 112 and the first lower rail 114, and a second space is formed on the second side of the device between the second upper rail 112 and the second lower rail 114. The supports 102 are coupled to the frame of the treadmill 100 and extend vertically upwards and away from the frame of the treadmill 100. In particular, the supports 102 extend at an angle relative to a vertical plane towards a front end of the treadmill 100. The front end of the treadmill is referred to as the end of the treadmill containing the display mount 120. The rear end of the treadmill is referred to as the end of the treadmill opposite the display mount 120. Further, the supports 102 are coupled to the frame closer to the front end than to the rear end. However, this depiction is not meant to be limiting. The supports 102 may also be perpendicular or substantially perpendicular to a horizontal axis of a surface supporting the treadmill 100. Additionally, in some embodiments, the supports 102 are located on the sides of the running belt in approximately the longitudinal middle portion of the treadmill 100. The supports 102 may be of unitary construction or constructed from two or more components. Further, in the example, shown, the supports 102 are of a metal or metal alloy construction. However, in other embodiments, the supports 102 may be constructed from a different type of material (e.g., plastic) or combination of sufficiently rigid materials. Moreover, the supports 102 are shown to be rectangular in shape. However, in other embodiments, a variety of other shapes may be implemented with the supports 102 (e.g., cylindrical, oval, triangular, octagonal, etc.).

As mentioned above, the left and right side supports 102 are identical in structure. In this regard and overall, the left and right sides of the handrail 110 are mirror images of each other. That is to say, if a cut line were placed in the top bar 134 all the way down to the base of the treadmill 100, the two cut pieces are identical in structure to each other. This is in align with the FIGS. 1-3 using the same reference number on the same, mirror component (e.g., upper rail 116 and upper rail 116). Therefore, to ease explanation of the handrail 110, only one side—the right side as shown in FIG. 3—will be described in detail. It is understood though that the same structure and function may be applicable with the mirrored left side of the handrail 110.

The upper rail 112 is an upper support surface or structure for a user of the treadmill 100. As shown, the upper rail 112 is cylindrical in shape and includes an upper back portion 116 and an upper front portion 118. The upper back portion 116 extends from a support 102 towards a back or rear portion of the treadmill 100. In some embodiments, the upper back portion 116 extends horizontally or substantially horizontally away from the support 102 (i.e., parallel to a horizontal plane). In some embodiments, the upper back portion 116 is angled slightly downward (i.e., toward a support surface for the treadmill) and away from the supports 102.

The upper front portion 118 is coupled to the upper back portion 116 and extends from the support 102 towards a front of the treadmill 100. In some embodiments, the upper front portion 118 is angled slightly upward and away from the support 102. In this regard, an angle is formed between the upper front portion 118 and the upper back portion 116. In some embodiments, the upper front portion 118 extends horizontally or substantially horizontally away from the support 102 before extending upward at an angle. Thus, in this instance, a plateau is formed from the support 102 and the upper front portion 118 before the upper front portion 118 angles upward, away, and towards the display mount 120 of the treadmill 100. In some embodiments, the upper front portion 118 extends substantially horizontally away from the support towards the front of the treadmill. In some embodiments, the upper front portion 118 extends to at or near the furthest frontward point of the running belt of the treadmill 100. In other embodiments and as shown, the upper front portion 118 extends beyond the furthest frontward point of the running belt of the treadmill 100.

The left upper front portion 118 and right upper front portion 118 are coupled to a display mount 120 proximate to a front end of the treadmill 100. The display mount 120 provides a location for a display device to be mounted. In one configuration and as shown, the display mount 120 is or is substantially perpendicular to each of the upper front portions 118 and extend between each of the upper front portions 118. Thus, the display mount 120 couples the two upper front portions 118 together. As shown, the upper front portion 118 and the display mount 120 is coupled via a corner 122. Corner 122 may be rounded, oblong, square, or form two corners, with a first corner coupling to the display mount 120, a second corner coupling to the upper front portion 118 and another portion/component extending between the first corner and the second corner. Thus, the corner 122 may have a variety of shapes, sizes, and configurations in order to accommodate the desired relative positioning between the display mount 120 and each of the upper front portions 118.

The lower rail 114 provides a lower support structure for a user of the treadmill 100. As shown, the lower rail 114 is cylindrical in shape and includes a lower back portion 124 and a lower front portion 126. The lower back portion 124 extends from the support 102 towards a back of the treadmill 100. In some embodiments, the lower back portion 124 extends horizontally or substantially horizontally away from the support 102 (i.e., at an angle that is parallel to a horizontal plane). In other embodiments and as shown, the lower back portion 124 is angled slightly downward (towards a ground or support surface for the treadmill 100) and away from the support 102. In some embodiments, the lower back portion 124 and the upper back portion 116 are parallel or substantially parallel to each other. In other embodiments, the lower back portion 124 and the upper back portion 116 are not parallel to each other.

The rear bar 128 extends from the lower back portion 124 towards the upper back portion 116. In some embodiments and as shown, the rear bar 128 extends perpendicularly from the lower back portion 124. In this regard, the rear bar 128 extends vertically upward and away from the lower back portion 124 at a substantially perpendicular angle. In other embodiments, the rear bar 128 extends vertically from the lower back portion 124 regardless of the angle of the lower back portions 124. In still other embodiments and as shown, the rear bar 128 is angled towards the back of the treadmill 100 before reaching the upper back portions 116. In any of the aforementioned embodiments, the rear bar 128 is coupled to the lower back portion 124. Thus, the rear bar 128 may be coupled to both the lower back portion 124 and the upper back portion 116. As shown, the rear bar 128 couples to the upper back portion 116, where the upper back portion 116 includes a terminal or end portion 130 that extends further backward relative to the coupling point between the rear bar 128 and the upper back portion 116. The end portion 130 may provide another support structure for a user of the treadmill 100 during one or more exercise or therapeutic routines using the treadmill 100. In an alternate embodiment, no end portion 130 is provided such that the coupling point between the rear bar 128 and the upper back portion 116 is the rearward most point of the handrail 110.

The lower front portion 126 extends from the support 102 towards a front of the treadmill 100 and provides another support structure for various exercise and therapeutic routines. As shown, the lower front portion 126 extends slightly upward (i.e., toward the display) as the lower front portion 126 moves away from the support 102. In other embodiments, the lower front portion 126 extends horizontally or substantially horizontally away from the support 102 (i.e., at an orientation that is parallel to a horizontal plane). In some embodiments, the lower front portion 126 extends to the front-most point of the running belt of the treadmill 100. As shown, however, the lower front portion 126 extends frontward beyond the front-most point of the running belt of the treadmill 100. In an alternate embodiment, the lower front portion 126 extends to a point before the front-most point of the running belt of the treadmill 100.

The lower front portion 126 bends upward and towards the front of the treadmill 100 to create, form, or otherwise provide a push bar 132. In some embodiments, the push bar 132 extends perpendicularly upward from the lower front portion 126. As shown, however, the push bar 132 is at an obtuse angle relative to the lower front portion 126. The push bar 132 extends In addition to this upward angle (i.e., angle relative to the lower front portion 126), the push bar 132 also is angled towards the display of the treadmill 100. In the embodiment shown, the push bar 132 is positioned at least partly above the first upper bar and the second upper bar. In particular, the push bar 132 extends vertically above and passed the first upper bar. In some embodiments, the push bar 132 is positioned to be closer to the back of the treadmill 100 than to the display mount 120. In some embodiments, the push bar 132 is positioned next to/adjacent to the display mount 120. In some embodiments, the push bar 132 is positioned closer to the front of the treadmill 100 than the display mount 120. That said, the push bar 132 is positioned to not interfere with the display mount 120 or a display mounted on the display mount 120. In some embodiments, the push bar 132 couples to the upper front portion 118, the display mount 120 and/or the corners 122.

As the push bar 132 reaches the front of the treadmill 100, the push bar 132 bends towards a longitudinal center of the treadmill 100 to create, from, or otherwise provide a top bar 134. Thus, the top bar 134 interconnects or couples the two push bars 132 together. As shown, the top bar 134 is located vertically above a display mounted on the display mount 120. The top bar 134 is substantially perpendicular to the push bars 132 and, as mentioned above, extends between the push bars 132. As shown, the push bars 132 and the top bar 134 are coupled via a corner 136. The corner 136 may be rounded, oblong, square, or form two corners, with a first corner coupling to the top bar 134, a second corner coupling to the push bars 132 and a straight component extending between the first corner and the second corner. The corner 136 may be used to create any type of desired angle between the push bars 132 and the top bar 134. For example and as shown, a substantially perpendicular relationship is formed between the push bars 132 and the top bar 134 such that the top bar 134 is substantially parallel to a horizontal plane. However, in other embodiments, the corners 136 may be structured such that the top bar 134 is at an angle, other than substantially ninety-degrees, relative to the push bars 132.

As described herein, the handrail 110 provides several functional features and benefits to users of the treadmill 100. Before turning to these features and benefits, a console configuration for a treadmill is shown according to an exemplary embodiment in FIG. 4. While the console configuration 200 (also referred to herein as a handrail assembly or grip assembly) may be utilized with the treadmill 10 or the treadmill 200 of U.S. patent application Ser. No. 15/640,180, in the example shown, the console 200 is utilized with the treadmill 200. However and for clarity purposes, the remaining portions of the treadmill 200 are not depicted; only the console 200.

As shown, the console 200 generally includes a base 202, display screen 204, storage compartments 206 and 208, and a bar or member that couples the first and second portions 210, which is shown as push bar or push member components 212-218. Console 200 generally includes a front portion and a back portion, wherein the front portion is positioned towards the front end of the treadmill as shown in FIGS. 1-3. Push bar components 212-218 may be substantially the same as push bar 132 in FIGS. 1-3, or may comprise a separate push bar. These components are described in more detail below. For reference purposes and in the same manner as described with FIGS. 1-3, as used herein when referring to a relative position of a component or where that component extends towards/from, the term "front" refers to locations or positions proximate to the display of the console 200 while the term "rear" or "back" refers to locations or positions away from the display of the console 200.

The base 202 serves as base member or support structure for various components of the console 200. While not shown, the base 202 may also be structured to couple to support structures and to couple the base 202 (and components coupled thereto) to the treadmill 200 (of U.S. patent application Ser. No. 15/640,180). As shown, the base 202 supports a display screen 204. The display screen 204 may enable a user to input information (e.g., his/her weight, age, desired length of routine, complexity of routine, pick an exercise workout or therapeutic routine (i.e., a preprogrammed routine), etc.). Thus, the display screen 204 may be a touchscreen or other type of input/output device. In other configurations, one or more buttons, levers, switches, and the like may be positioned elsewhere on the treadmill and/or console 200. As shown, the display screen 204 is coupled to a back portion of the base 202. In one embodiment, the display screen 204 is coupled to the base 202 such that the display screen 204 is perpendicular to the base 202. In other embodiments and as shown, the display screen 204 is angled outward and away from the base 202 such that the display screen 204 faces upward.

The base 202 is shown to include various storage compartments 206. In the example depicted, the base 202 includes two storage compartments 206 (also referred to as a pair of compartments), one on each side of the base 202 (located on opposing sides of the base). Storage compartments 206 may be sized and shaped such that a water bottle can be received by the storage compartment 206 and/or various other items (e.g., mobile phone, keys, food, wallet, etc.). In this regard, a variety of shapes and sizes of the storage compartments 206 may be used: square, circular, rectangular, etc. and be of varying depths to, e.g., reduce the chances of an item place therein such as a water bottle from tipping over or falling out of the storage compartment 206. In one embodiment, both storage compartments 206 are identical. In other embodiments, a different structure and size is implemented with one storage component 206 relative to the other component. Further, while only two storage components 206 are implemented, in other embodiments, more than two or less than two storage compartments may be used.

The base 202 is also shown to define and include a storage compartment 208 (also referred to as a third compartment). As shown, the storage compartment 208 extends between the storage compartments 206 (pair of compartments) and may be configured to receive and hold smaller items (e.g., loose change, keys, eye-glasses, etc.). For example, storage compartment 208 may allow a phone to be place inside, while maintaining the phone at an angle such that a user could view the screen of the phone while using the treadmill. In some embodiments, the storage compartment 208 may also be able to hold a book, magazine, or other reading material or device.

The base 202 also includes a pair of side supports 210 (also referred to as first portion and a second portion) that extend away, particularly horizontally or laterally away, from the base 202 along the sides of the base 202 (the first portion extending from a first side of the base and the second portion extending from the second side of the base). In this regard, one side support 210 is positioned on an opposite side of the console 200 relative to another side support 210. Further and as shown, if an imaginary cut line was provided through the middle of the display screen 204 and the console 200, each of the respective left and right sides would be identical/mirror images of each other. Thus, while the various components of the console 200 are described in the singular form, it is understood that the same structure and configuration is true for the corresponding component on the other side of the console 200. Therefore and for the sake of clarity, only one side of the console 200 is primarily described with the exception where various components on one side couple to/relate to components on the side of the console 200.

The side support 210 is coupled to a lower push bar 212 (also referred to as the lower section or member), which extends inward from the side support 210 (i.e., towards the opposite side support 210 or, in other words, towards a longitudinal center portion of the treadmill). Lower push bar 212 on the first side of the base 202 and lower push bar 212 on the second side of the base 202 form a pair of lower sections or lower push bars. The pair of lower sections extend substantially inward and away from the first side of the base and the second side of the base, respectively (i.e., the lower push members extends towards a longitudinal center portion of the treadmill). In another embodiment, the lower push bar 212 is excluded from the console 200. In the embodiment depicted that includes the lower push bar 212, the lower push bar 212 is of a sufficient size (e.g., length) to receive a hand of a user (i.e., for a user to grip/hold). In an alternate embodiment, the lower push bar 212 is of an insufficient length to receive a hand of a user and instead may be used as a spacer between the side support 210 and a vertical bar 214.

The vertical bar 214 (also referred to as the vertical section or vertical member) is shown to extend angular upwards (i.e., away from a ground or support surface for the treadmill) from the lower push bar 212. Vertical bar 214 on the first side of the base 202 and vertical bar 214 on the second side of the base 202 form a pair of vertical sections (i.e., first and second vertical sections) or vertical push bars. The pair of vertical sections extend are coupled to and extend at an angle substantially upwards from the pair of lower sections. The angle of extension from or relative to the lower push bar may be a variety of angles including an acute angle, an obtuse angle, and a right angle. The vertical bar 214 is configured to couple lower push bar 212 to upper push bar 216. In addition to this angular configuration, a secondary angular configuration may also be implemented with the vertical bar 214 whereby the vertical bar 714 is angled towards the display screen 204. In another embodiment, the vertical bar 214 is angled away from the display screen 204. In yet another embodiment, the vertical bar 214 is substantially vertical and not angled away or to the display screen 204.

An upper push bar 216 (also referred to as the upper section or upper member) extends from the vertical bar 214 inwards towards a longitudinal middle of the treadmill. The upper push bar 216 may be positioned along the vertical bar 214 such that a protrusion 218 is created. The protrusion 218 may provide an additional length for the vertical bar 214 (e.g., to fit a hand), while keeping the upper push bar 216 at a desirable height relative to a support surface for the treadmill. The protrusion may be configured to engage with the hand of the user. The protrusion 218 may extend substantially upwards and above the upper push bar 216. The upper push bar 216 may extend horizontally or substantially horizontally from the vertical bar 214. In some embodiments, the upper push bar 216 has a slight curve to provide a more ergonomic position for the user. In this regard and as shown, the upper push bar 216 is curved whereby an apex of the curve is positioned upward relative to the remaining portions of the curve of the bar 216. As shown, the upper push bar 216 is also angled or curved towards the display screen 204. Thus and as shown, the upper push bar 216 curves both upward and toward the display screen 204. To facilitate an ease of use of the user, the upper push bar 216 includes a texturing or covering to provide appeal-ability of use. In certain embodiments, the upper push bar 216 (or various other components of the console 200) include one or more sensors to acquire or collect information or data from or related to a user (e.g., heart rate, etc.).

In some embodiments, a portion 220 (also referred to as platform) is included between the upper push bars 216. The portion 220 may extend towards the front area of the console 200. In the example shown, the portion 220 is a platform that may provide a surface for resting a phone, book, reading material, and/or other objects. In this embodiment, the platform may be textured to hold objects in place. Additionally, the platform may include a ridge at a lower portion of the platform to prevent objects from sliding off the platform. However, in other embodiments and as alluded to above, the portion 220 includes a control panel comprising one or more buttons, levers, switches, and the like to enable a user to exchange information with a control system of the user to, e.g., pick a workout, enter information, choose which information/date is outputted via the display screen 204, and the like. In either embodiment, the portion 220 may be angled to provide a better viewing angle of the user.

It should be understood that a variety of shapes and sizes may be implemented with the push bar components 212-218. For example, the push bar components 212-218 may be cylindrical, substantially cylindrical, conical, substantially conical or a combination thereof. The low profile of the push bar components 212-218 increases ease of access to the storage compartments 206 and 208 and may increase access to the push bars 132 of FIGS. 1-3.

With the above in mind, the remaining Figures of the present disclosure depict users utilizing the handrails 110 of FIGS. 1-3. As described herein and with references to these Figures, the handrails 110 provide several benefits for enabling a user to engage in a plurality of exercises and therapeutic routines that are not typical of traditional or conventional treadmills.

Figure 5:
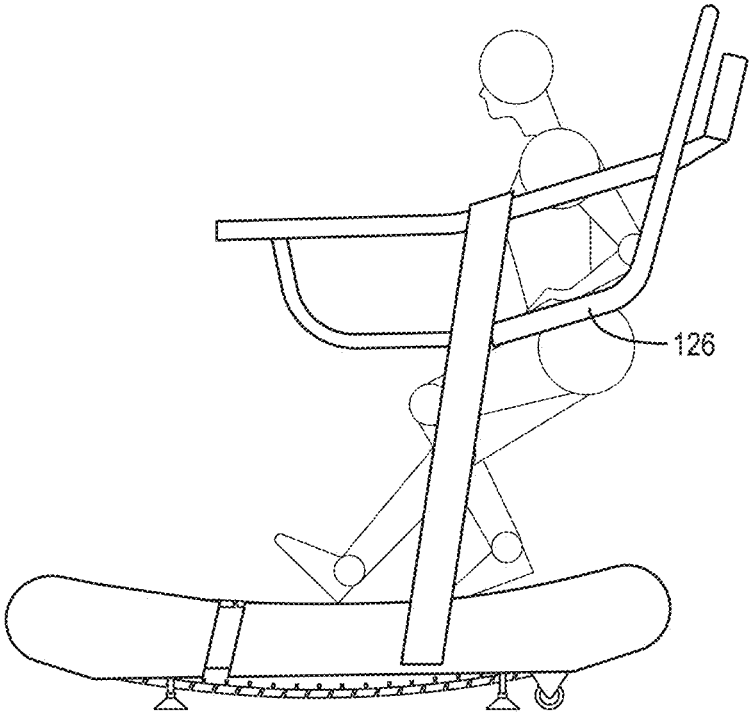
FIG. 5 shows a user doing a leg extension exercise on the treadmill with the handrails of FIG. 1, according to an exemplary embodiment.

Referring now to FIG. 5, a user doing a leg extension exercise on the treadmill 100 with handrails 110 of FIG. 1 is shown, according to an exemplary embodiment. When doing this exercise, the user places their hands on the lower front portion 126 to support or at least partially support the user's weight while pushing his/her legs toward the back of the treadmill 100. The angle of the lower front portion 126 decreases stress on the wrists to provide a comfortable position for the user to perform this exercise properly.

Figure 6:
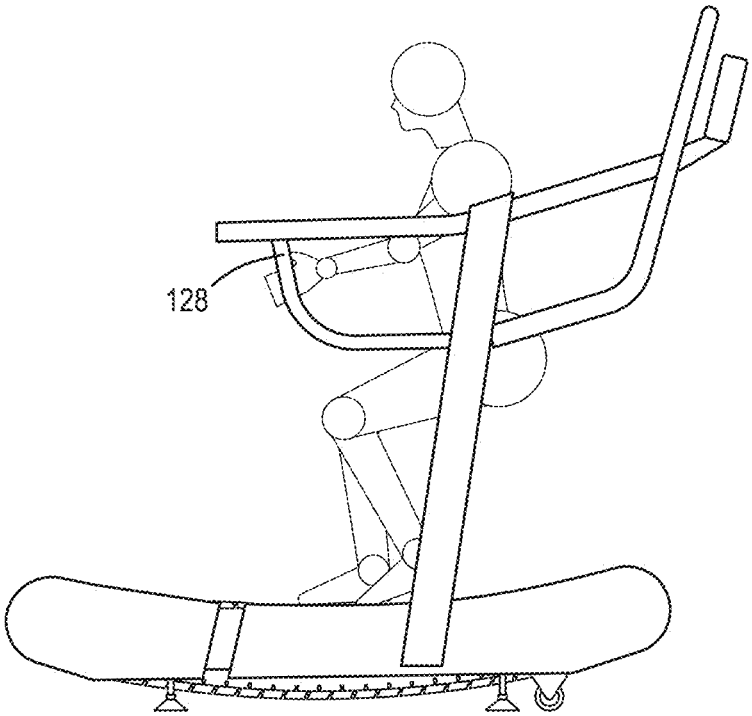
FIG. 6 shows a user doing a reverse push exercise on the treadmill with the handrails of FIG. 1, according to an exemplary embodiment.

FIG. 6 shows a user doing a reverse push exercise on the treadmill with the handrails 110 of FIG. 1, according to an exemplary embodiment. When doing this exercise, the user places their hands on the rear bars 128 to support or at least partially support the user while he/she moves their legs toward the front of the treadmill 100. The angle of the rear bars 128 decreases stress/force on the user's wrists to provide a comfortable position for the user to perform this exercise properly while maintaining a proper positioning of a back of the user.

Figure 7:
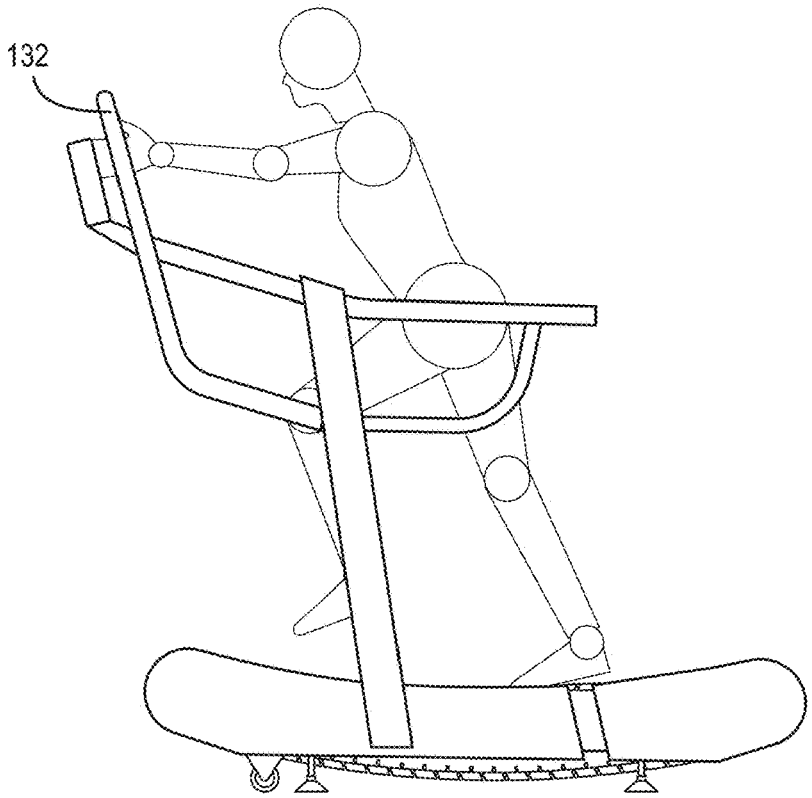
FIG. 7 shows a user doing an upper pushing exercise with extended arms on the treadmill with the handrails of FIG. 1, according to an exemplary embodiment.

FIG. 7 shows a user doing an upper pushing exercise with extended arms on the treadmill 100 with handrails 110 of FIG. 1, according to an exemplary embodiment. When doing this exercise, the user places their hands on the push bars 132 to counteract a force that the user creates/exerts while he/she pushes their legs towards the back of the treadmill 100 in a pushing manner. The angle of the push bars 132 decreases the stress/force on the wrists to provide a comfortable position for the user to perform this exercise properly while maintaining proper positioning of a back of the user. The height of the push bars 132 also allows the user to fully extend their arms without compromising the position of the back of the user. This exercise may be desirable for users working to strength train their legs, such as their quadriceps, hamstrings, calf muscles, and various other leg muscles.

Figure 8:
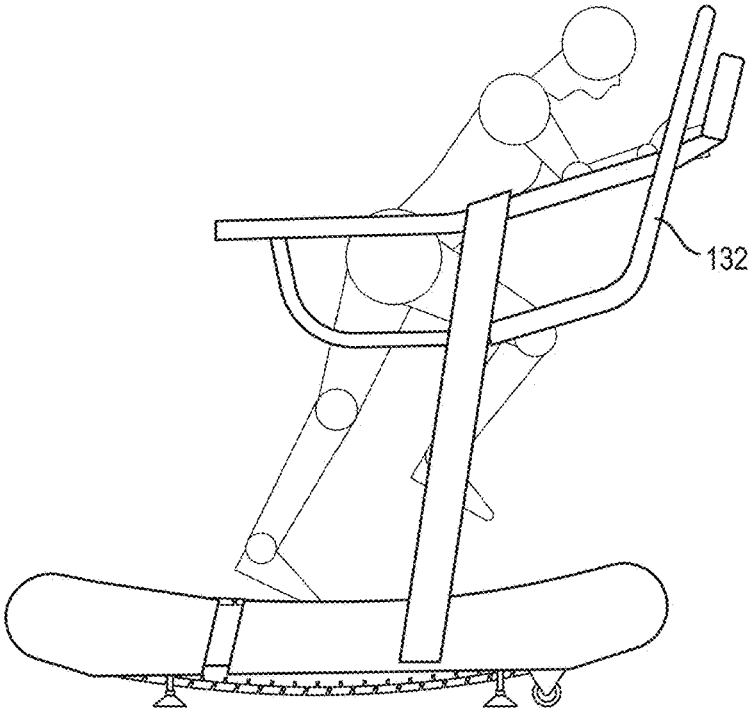
FIG. 8 shows a user doing an upper pushing exercise on the treadmill with the handrails of FIG. 1, according to an exemplary embodiment.

FIG. 8 shows a user doing an upper pushing exercise on the treadmill 100 with handrails 110 of FIG. 1, according to an exemplary embodiment. When doing this exercise, the user places their hands on the push bars 132 to stabilize the user and provide a support structure for the user while he/she pushes the running belt of the treadmill in a sled-type exercise. This is similar to that of FIG. 7, except for the positioning of the user relative to the handrails 110. In this regard, the height of the push bars 132 may allow the user to comfortably bend their arms without compromising the position of the back or head of the user.

Figure 9:
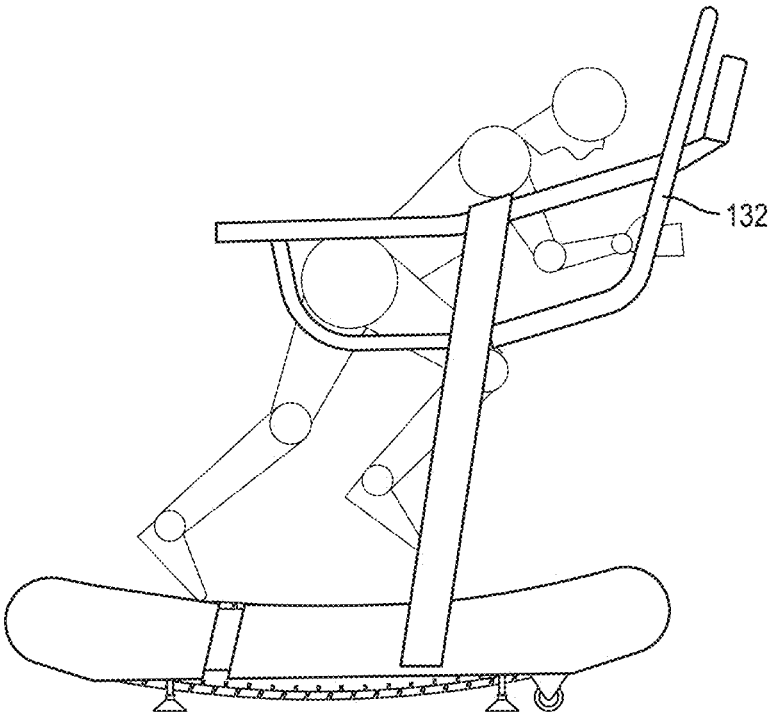
FIG. 9 shows a user doing a lower pushing exercise on the treadmill with the handrails of FIG. 1, according to an exemplary embodiment.
Figure 10A:
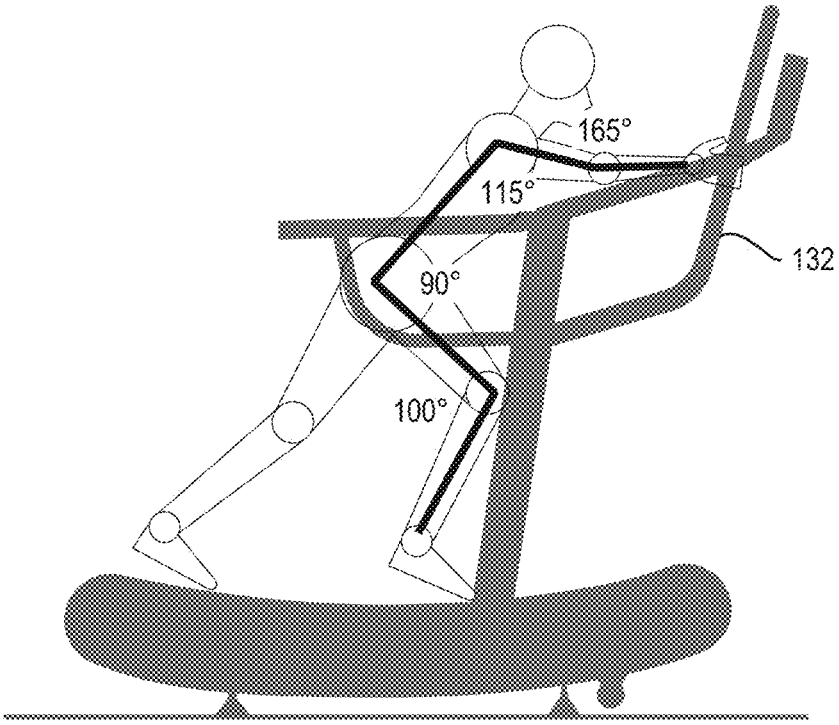
FIGS. 10A-10B show a female in the $95^{th}$ percentile of height doing an upper pushing exercise on the treadmill with handrails of FIG. 1, according to an exemplary embodiment.
Figure 10B:
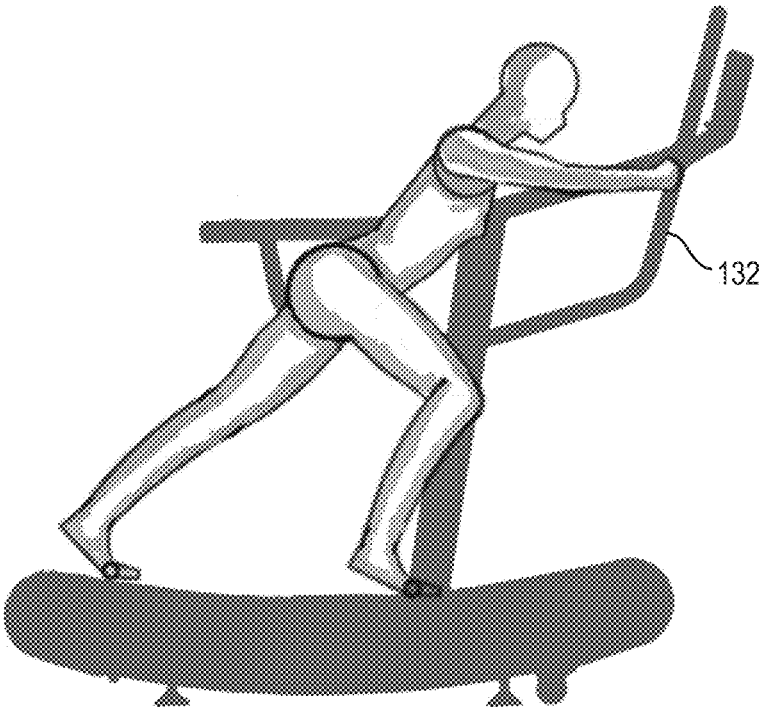
Figure 11A:
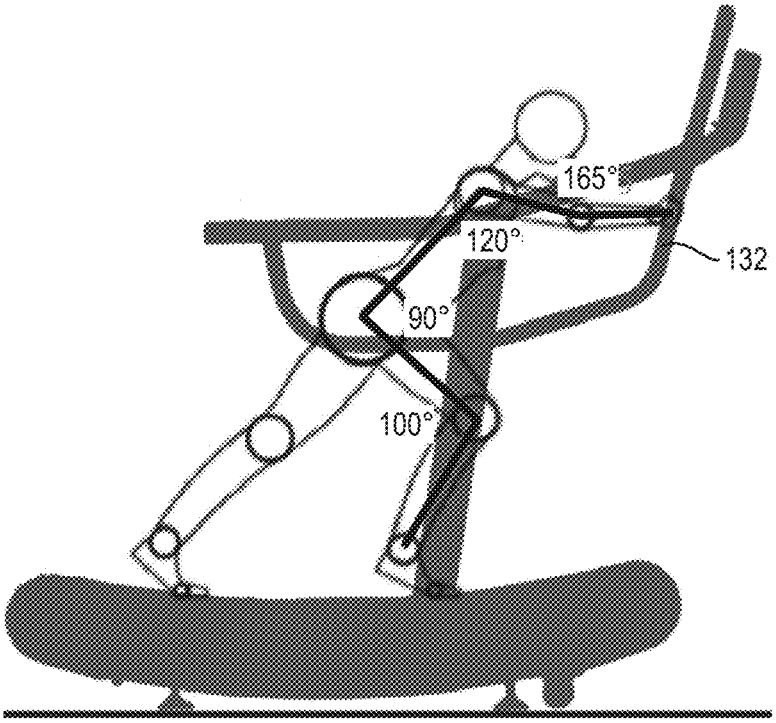
FIGS. 11A-11B show a female in the $5^{th}$ percentile of height doing an upper pushing exercise on the treadmill with the handrails of FIG. 1, according to an exemplary embodiment.
Figure 11B:
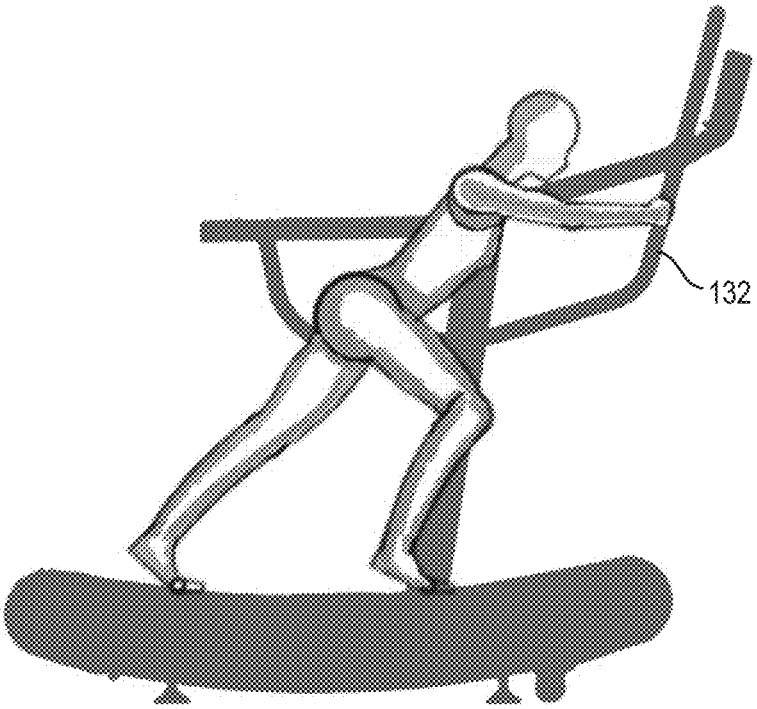
Figure 12A:
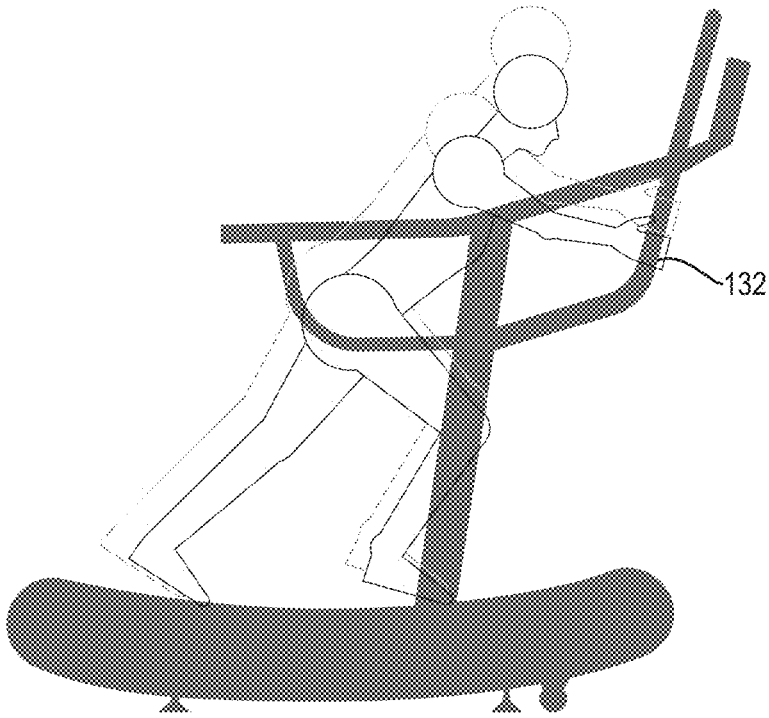
FIGS. 12A-12B show a comparison of a female in the $95^{th}$ percentile and in the $5^{th}$ percentile of height doing an upper pushing exercise on the treadmill with the handrails of FIG. 1, according to an exemplary embodiment.
Figure 12B:
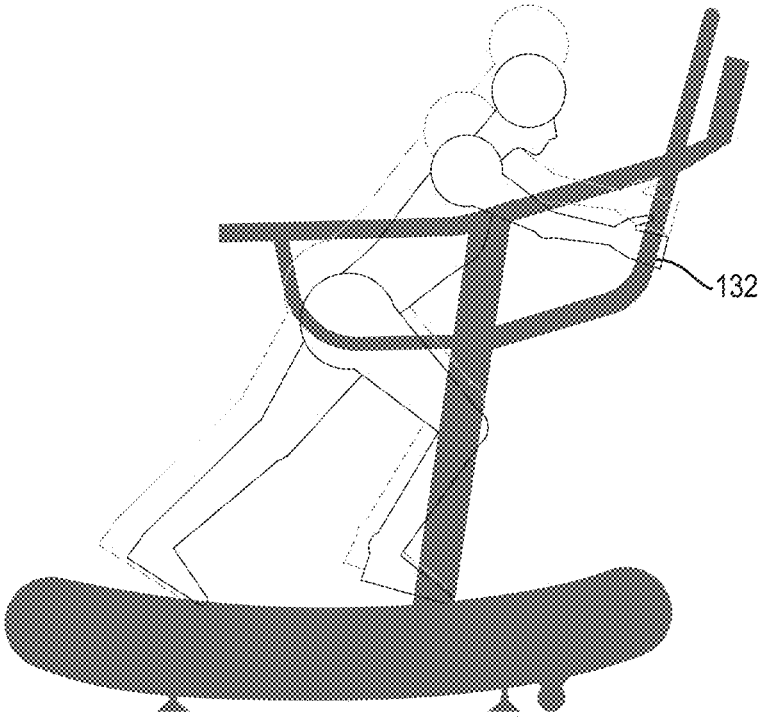
Figure 13A:
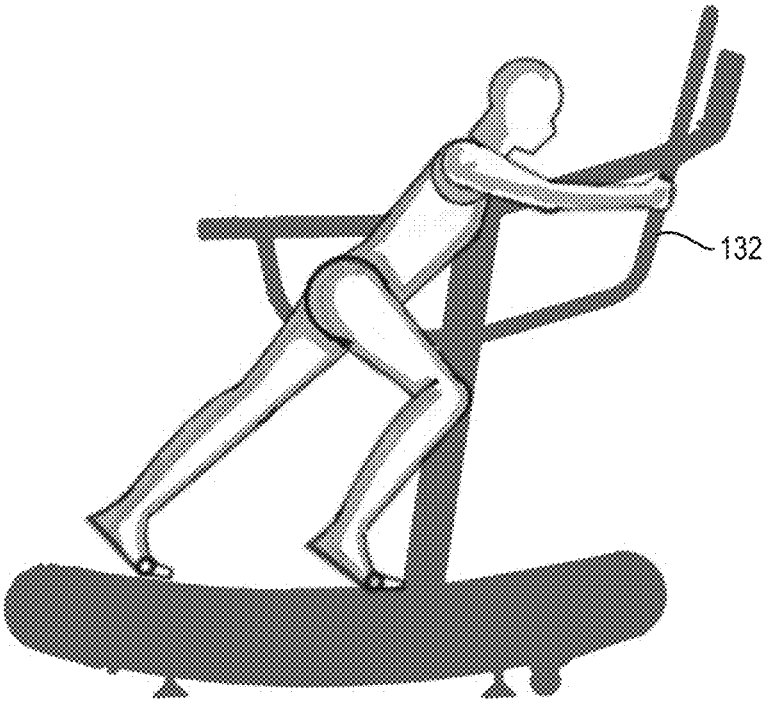
FIG. 13A shows a male in the $95^{th}$ percentile of height doing an upper pushing exercise on the treadmill with the handrails of FIG. 1, according to an exemplary embodiment.
Figure 13B:
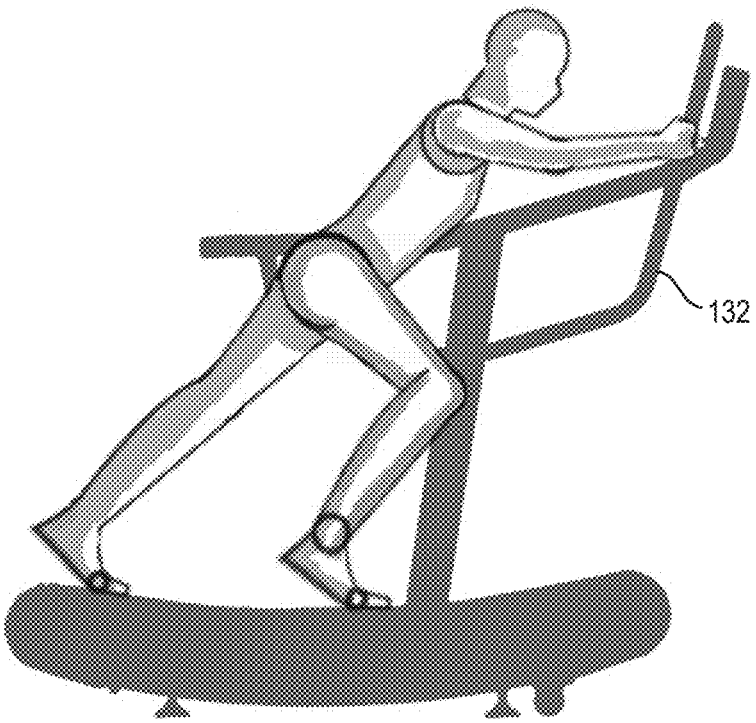
FIG. 13B shows a male in the $5^{th}$ percentile of height doing an upper pushing exercise on the treadmill with the handrails of FIG. 1, according to an exemplary embodiment.
Figure 14A:
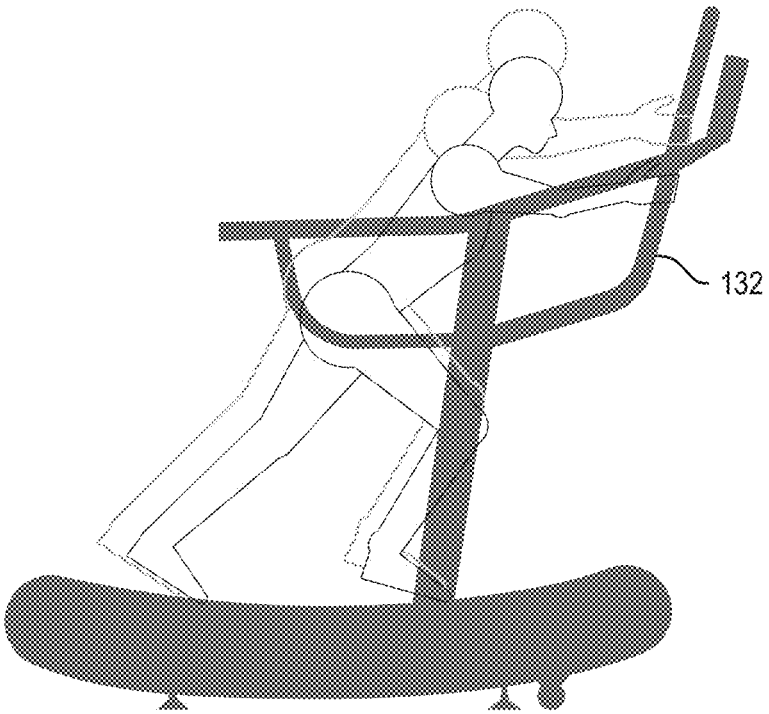
FIGS. 14A-14B show a comparison of a male in the $95^{th}$ percentile and in the $5^{th}$ percentile of height doing an upper pushing exercise on the treadmill with the handrails of FIG. 1, according to an exemplary embodiment.
Figure 14B:
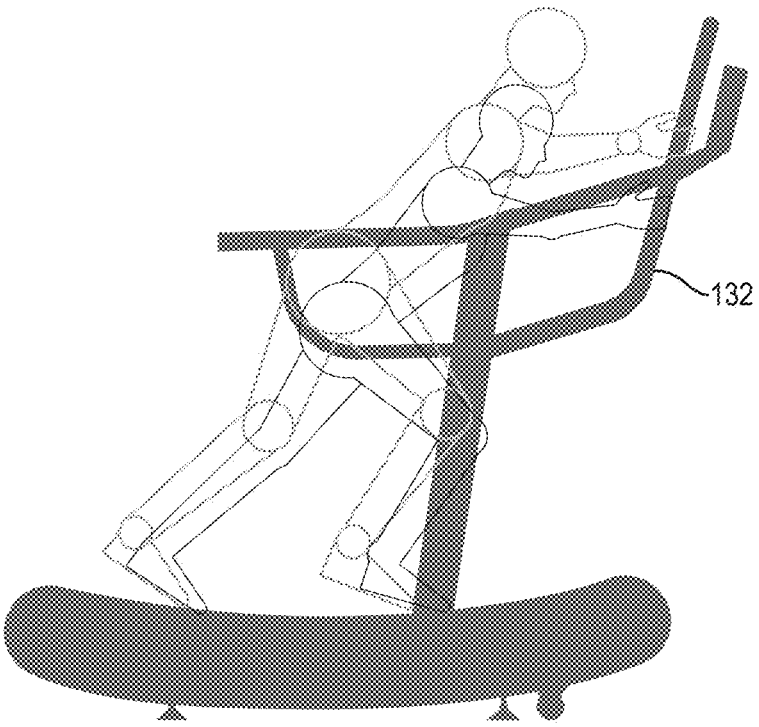
Figure 15A:
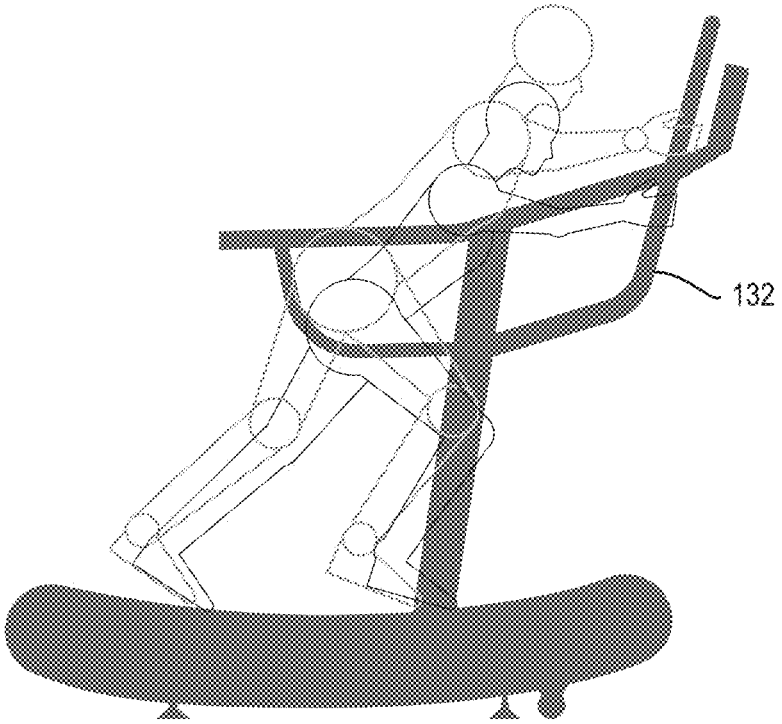
FIGS. 15A-15B show a comparison of a male in the $95^{th}$ percentile and a female in the $95^{th}$ percentile of height doing an upper pushing exercise on the treadmill with handrails of FIG. 1, according to an exemplary embodiment.
Figure 15B:
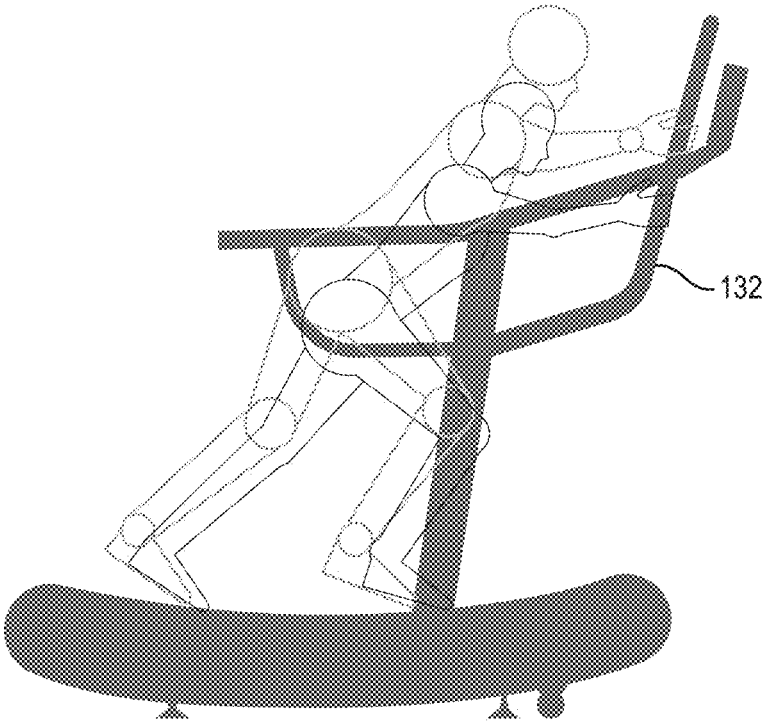

FIG. 9 shows a user doing a lower pushing exercise on the treadmill 100 with handrails 110 of FIG. 1, according to an exemplary embodiment. When doing this exercise, the user places their hands on the push bars 132 and pushes the running belt of the treadmill using their lower body. This exercise is similar to that of FIGS. 7-8, except for the relative positioning of the user. In this regard and as will be appreciated by those of ordinary skill in the art, the position of the bars to enable a user to have a variety of positions may function to work several muscle groups using the treadmill and avoid having to use a variety of exercise and/or therapeutic equipment pieces to achieve the same or similar benefit. As with FIGS. 7-8, the angle of the push bars 132 decreases the stress/force on the wrists to provide a comfortable position for the user to perform the exercise properly while maintaining proper positioning of a back of the user. Further, the height of the push bars 132 also allows the user to comfortably bend their arms without compromising the position of the back of the user.

FIGS. 10A-15B show various users doing an upper pushing exercise on the treadmill 100 with handrails 110 of FIG. 1, according to an exemplary embodiment. Thus, FIGS. 10A-15B depict body mechanisms of users doing the upper pushing exercises of FIGS. 7-9. In this regard, various user angles of their joints/limbs are shown to depict how a user may interact with the handrails 110 while doing the various exercises or therapeutic routines. In each Figure, the user places, grabs, and holds their hands on the push bars 132 while pushing the running belt of the treadmill with, substantially, their lower body. The interaction of their upper body (e.g., arms and hands) with the push bars 132 provides a stabilizing/counteracting force to the lower force created from the pushing on the running belt.

Figure 16A:
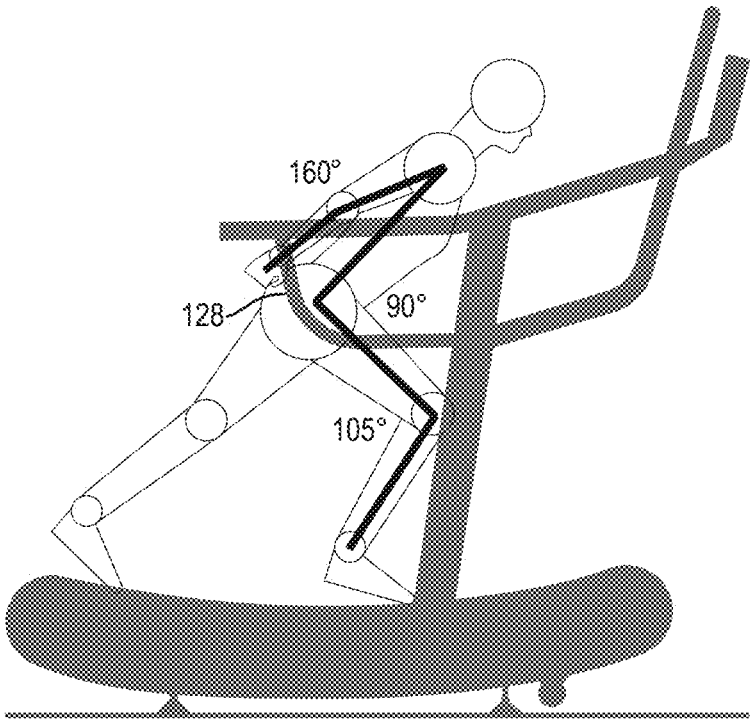
FIGS. 16A-16B show a female in the $95^{th}$ percentile of height doing a pull exercise on the treadmill with the handrails of FIG. 1, according to an exemplary embodiment.
Figure 16B:
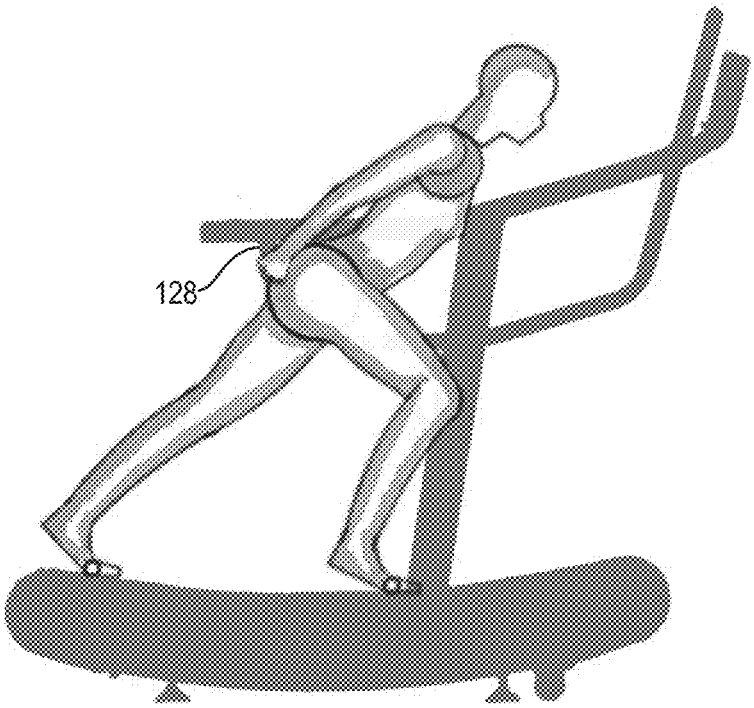

FIGS. 16A-16B show a female in the $95^{th}$ percentile for height doing a pull exercise on the treadmill 100 with handrails 110 of FIG. 1, according to an exemplary embodiment. When doing this exercise, the user places their hands on the rear bars 128 to support the user while moving the legs of the user toward the front of the treadmill 100. The angle of the rear bars 128 decreases stress on the wrists to provide a comfortable position for the user to perform the exercise properly while maintaining proper positioning of a back of the user and allowing the user to keep their arms fully extended. The height of the rear bars 128 also allow users of various heights to perform the exercise with proper form.

Figure 17:
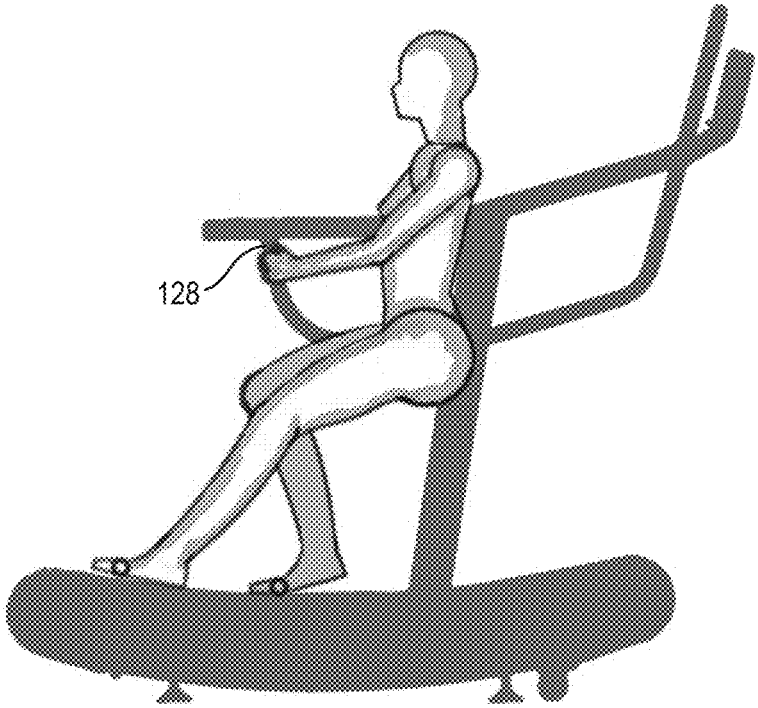
FIG. 17 shows a female doing a reverse pull exercise on the treadmill with the handrails of FIG. 1, according to an exemplary embodiment.

FIG. 17 shows a female doing a reverse pull exercise on the treadmill 100 with handrails 110 of FIG. 1, according to an exemplary embodiment. When doing this exercise, the user places their hands on the rear bars 128 to support the user while moving the legs of the user toward the back of the treadmill 100. The angle of the rear bars 128 decreases stress on the wrists to provide a comfortable position for the user to perform the exercise properly while maintaining proper positioning of a back of the user and allowing the user to keep their arms fully extended. The height of the rear bars 128 also allow users of various heights to perform the exercise with proper form.

Figure 18:
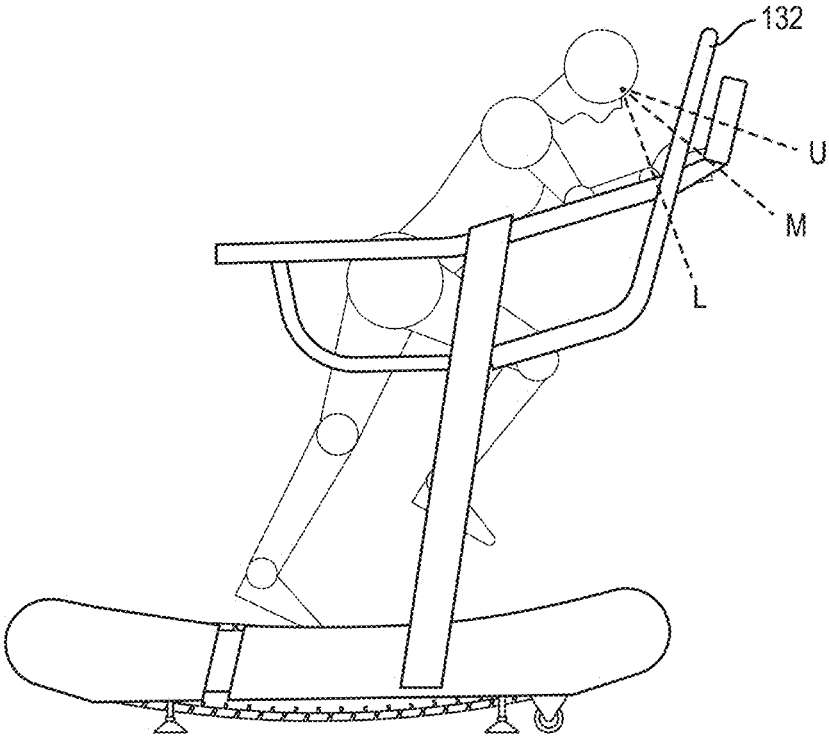
FIG. 18 shows eye angles of a user doing an upper pushing exercise on the treadmill with the handrails of FIG. 1, according to an exemplary embodiment.

FIG. 18 shows eye angles of a user doing an upper pushing exercise on the treadmill 100 with handrails 110 of FIG. 1, according to an exemplary embodiment. According to the present disclosure, the angle and location of the display screen of the treadmill 100 allows a user to view the display screen easily or relatively easily. The display screen extends from the base at such an angle that the user may view a substantial portion of the display screen when performing therapeutic programs or workouts. The various angles of the eye are depicted as a midline (M), an upper angle (U) and a lower angle (L). As can be seen in FIG. 18, the user is able to perform the exercise with proper form while maintaining the display device in the upper angle (U) of their vision, minimizing the risk of head rotation of the user, which would compromise form.

Figure 19:
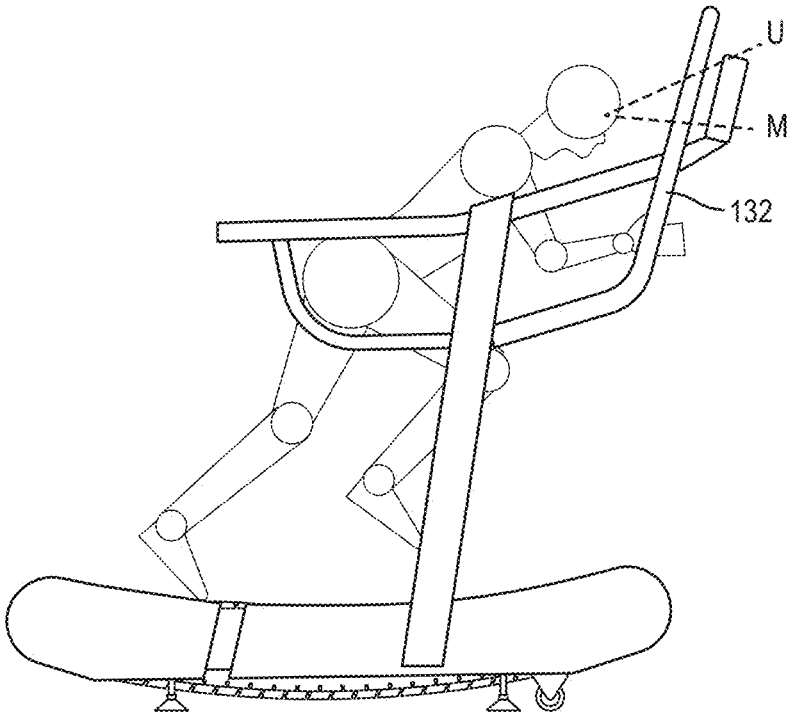
FIG. 19 shows eye angles of a user doing a lower pushing exercise on the treadmill with the handrails of FIG. 1, according to an exemplary embodiment.

FIG. 19 shows eye angles of a user doing a lower pushing exercise on the treadmill 100 with handrails 110 of FIG. 1, according to an exemplary embodiment. As discussed above, when doing this exercise, the user places their hands on the push bars 132 to at least partially support the user while pushing the legs of the user toward the back of the treadmill 100. The angle and location of the display screen allows a user to view the display screen easily or relatively easily. The various angles of the eye are depicted as a midline (M) and an upper angle (U). As can be seen in FIG. 19, the user is able to perform the exercise with proper form while maintaining the console 700 between the midline angle (M) and the upper angle (U) of their vision, minimizing the risk of head rotation of the user, which would compromise form.

Figure 20:
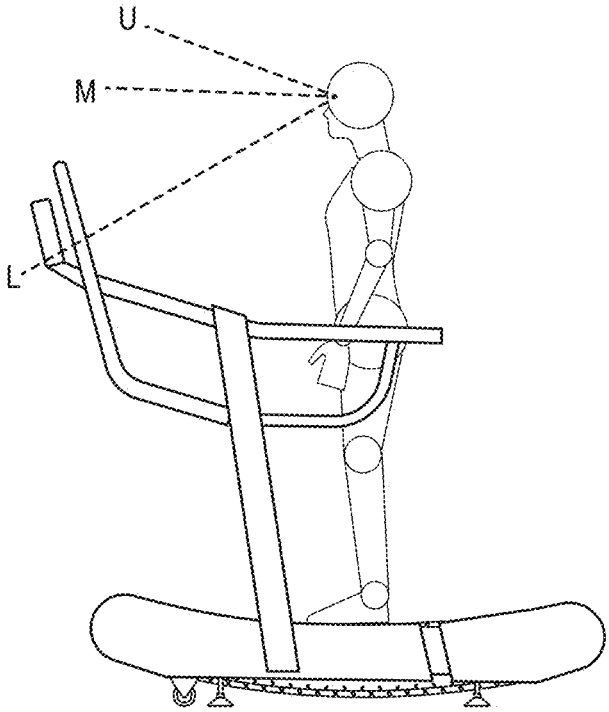
FIG. 20 shows eye angles of a user standing on the treadmill with handrails of FIG. 1, according to an exemplary embodiment.

FIG. 20 shows eye angles of a user standing on the treadmill 100 with handrails 110 of FIG. 1, according to an exemplary embodiment. The various angles of the eye are depicted as a midline (M), an upper angle (U) and a lower angle (L). As can be seen in FIG. the user is able to walk or run with proper form while maintaining the eye-sight of display screen in the lower angle (L) of their vision, which minimizes the risk of head rotation of the user while performing various exercise and therapeutic routines to avoid compromising form of those routines.

Therefore, the handrails 110 are configured to allow a user to perform a variety of exercises by using push bars, rear bars and lower bars without causing excessive strain on the user or compromising form. In addition, the location of the display screen on the handrails 110 allows the user to view the display screen during the exercises without needing to rotate their head, which would compromise form. By maintaining proper form during various exercises, the risk of injury to the user is decreased.

It should be understood and appreciated that similar types of exercises may be utilized with the console 200 and the bars 212, 214, and 216. Thus, users may perform at least some of the sled-type exercises and the other described exercises and therapeutic routines described above using the console 200. A few exemplary positions are shown in FIGS. 21-24.

Figure 4:
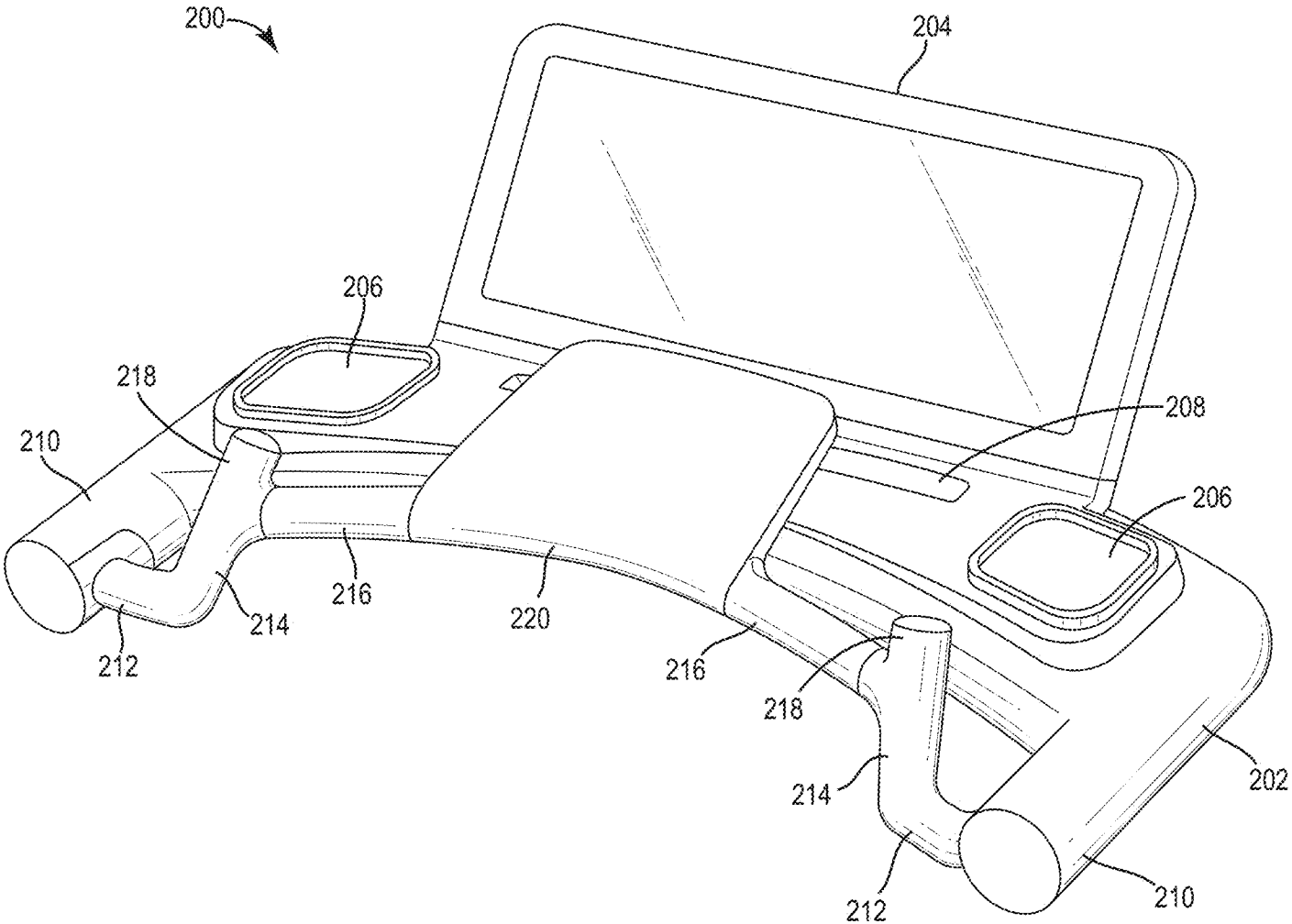
FIG. 4 is a perspective view of a display for the treadmill with the handrails of FIG. 1, according to an exemplary embodiment.
Figure 21:
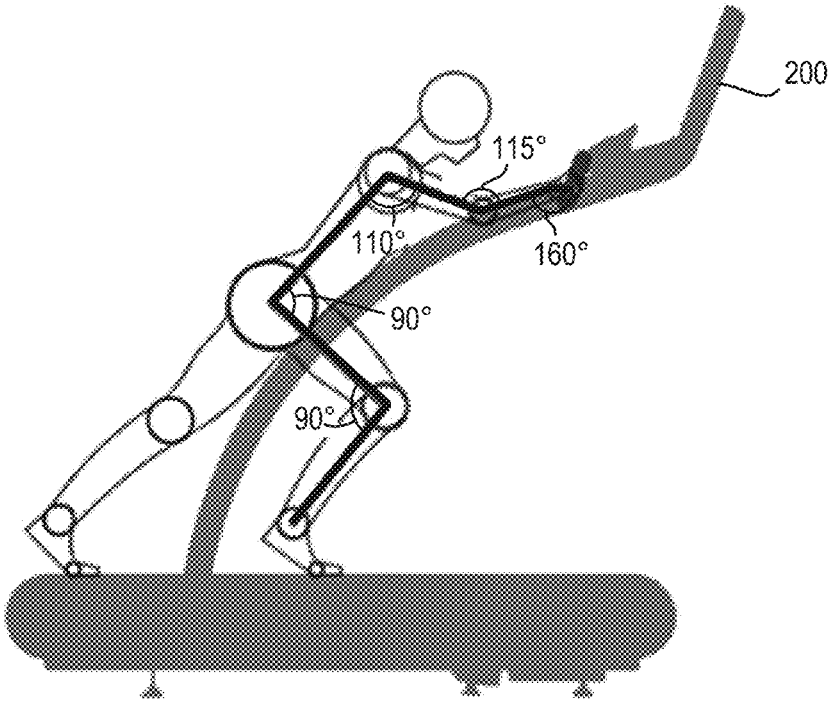
FIG. 21 shows a female in the $5^{th}$ percentile of height doing a push exercise on the treadmill with the console of FIG. 4, according to an exemplary embodiment.

FIG. 21 shows a female in the $5^{th}$ percentile for height doing a push exercise on the treadmill 100 with the console 200 of FIG. 4, according to an exemplary embodiment. The user places, grabs, and holds their hands on the vertical bars 214 while pushing the running belt of the treadmill with, substantially, their lower body. The interaction of their upper body (e.g., arms and hands) with the vertical bars 214 provides a stabilizing/counteracting force to the lower force created from the pushing on the running belt. The height of the vertical bars 214 also allows users of various heights to perform the exercise with proper form. Alternatively, the user may grab at least one of the lower push bar 212 or the upper push bar 216 to do this exercise or therapeutic program.

Figure 22:
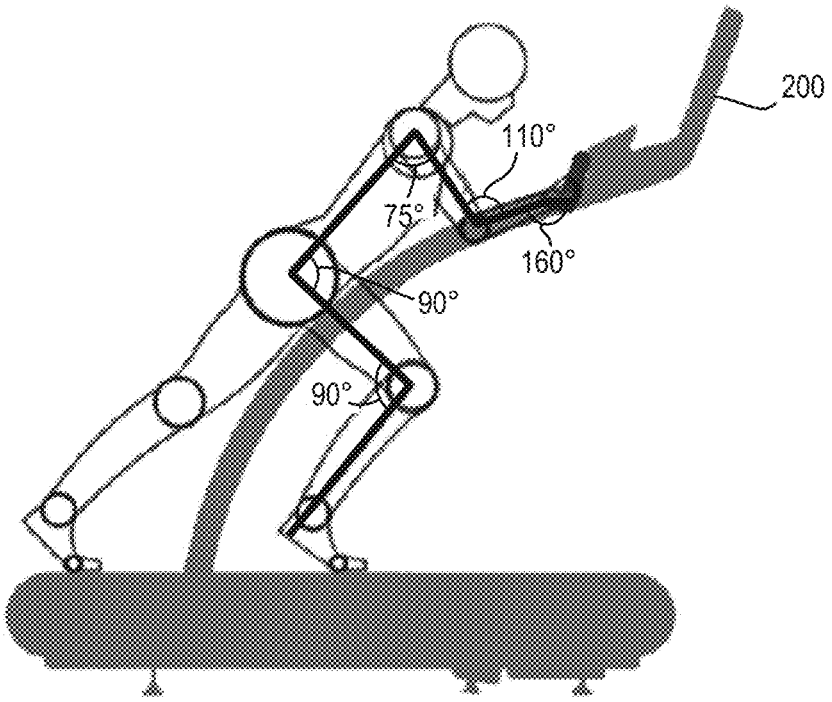
FIG. 22 shows a female in the $95^{th}$ percentile of height doing a push exercise on the treadmill with the console of FIG. 4, according to an exemplary embodiment.

FIG. 22 shows a female in the $95^{th}$ percentile for height doing a push exercise on the treadmill 100 with the console 200 of FIG. 4, according to an exemplary embodiment. The user places, grabs, and holds their hands on the vertical bars 214 while pushing the running belt of the treadmill with, substantially, their lower body. The interaction of their upper body (e.g., arms and hands) with the vertical bars 214 provides a stabilizing/counteracting force to the lower force created from the pushing on the running belt. The height of the vertical bars 214 also allows users of various heights to perform the exercise with proper form. Alternatively, the user may grab at least one of the lower push bar 212 or the upper push bar 216 to do this exercise or therapeutic program.

Figure 23:
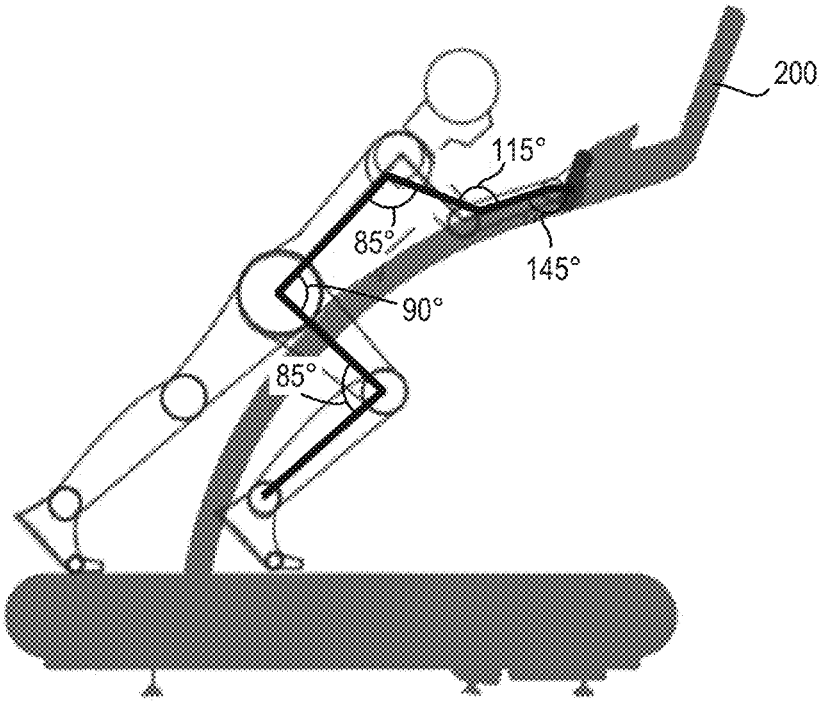
FIG. 23 shows a male in the $5^{th}$ percentile of height doing a push exercise on the treadmill with the console of FIG. 4, according to an exemplary embodiment.

FIG. 23 shows a male in the $5^{th}$ percentile for height doing a push exercise on the treadmill 100 with the console 200 of FIG. 4, according to an exemplary embodiment. The user places, grabs, and holds their hands on the vertical bars 214 while pushing the running belt of the treadmill with, substantially, their lower body. The interaction of their upper body (e.g., arms and hands) with the vertical bars 214 provides a stabilizing/counteracting force to the lower force created from the pushing on the running belt. The height of the vertical bars 214 also allows users of various heights to perform the exercise with proper form. Alternatively, the user may grab at least one of the lower push bar 212 or the upper push bar 216 to do this exercise or therapeutic program.

Figure 24:
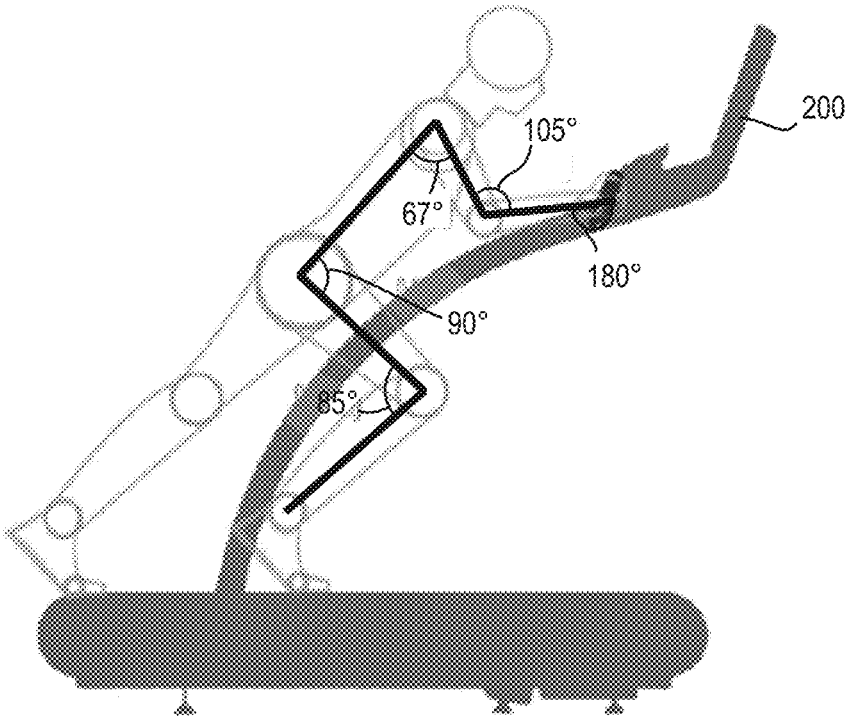
FIG. 24 shows a male in the $95^{th}$ percentile of height doing a push exercise on the treadmill with the console of FIG. 4, according to an exemplary embodiment.

FIG. 24 shows a male in the $95^{th}$ percentile for height doing a push exercise on the treadmill 100 with the console 200 of FIG. 4, according to an exemplary embodiment. The user places, grabs, and holds their hands on the vertical bars 214 while pushing the running belt of the treadmill with, substantially, their lower body. The interaction of their upper body (e.g., arms and hands) with the vertical bars 214 provides a stabilizing/counteracting force to the lower force created from the pushing on the running belt. The height of the vertical bars 214 also allows users of various heights to perform the exercise with proper form. Alternatively, the user may grab at least one of the lower push bar 212 or the upper push bar 216 to do this exercise or therapeutic program.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments and that such variations are intended to be encompassed by the present disclosure.

It is important to note that the constructions and arrangements of the treadmill as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed:

1. A treadmill, comprising:

a frame;

a first side support coupled to and extending substantially vertically upwards relative to the frame;

a second side support coupled to and extending substantially vertically upwards relative to the frame; and a handrail assembly having a first side coupled to the first side support and a second side coupled to the second side support, each of the first and second sides of the handrail assembly comprising upper and lower members vertically spaced from one another and front and rear push members spaced apart from one another along a longitudinal length of the treadmill, the front and rear push members coupling the upper and lower members, and collectively providing a plurality of hand placement positions including at least two substantially horizontally aligned hand placement positions and at least one primarily vertically aligned hand placement position.

2. The treadmill of claim 1, wherein the lower members include a first lower member coupled to the first side support and a second lower member coupled to the second side support, the first lower member and the second lower member each extending towards a rear end of the treadmill, wherein the upper members include a first upper member coupled to the first side support and a second upper member coupled to the second side support, wherein the rear push members include a first rear push member coupling the first lower member and the first upper member and a second rear push member coupling the second lower member and the second upper member, and wherein the front push members include a first front push member coupling the first lower member and the first upper member and a second front push member coupling the second lower member and the second upper member.

3. The treadmill of claim 2, wherein the first front push member and the second front push member each extend vertically above at least part of the first upper member and the second upper member.

4. The treadmill of claim 2, wherein the rear push members are rearward of the first and second side supports and the front push members are forward of the first and second side supports.

5. The treadmill of claim 2, wherein the first front push member is coupled to the second front push member via a top member disposed at least partially vertically above the first and second front upper members.

6. The treadmill of claim 1, wherein at least one of the upper or lower members includes a sensor configured to collect data relating to a usage of the treadmill.

7. A handrail assembly for a treadmill, the handrail assembly comprising:

a first side support coupled to and extending at least partially upwards from a base of a treadmill;

a second side support coupled to and extending at least partially upwards from the base of the treadmill and spaced apart from the first side support;

an upper member coupled to the first side support and the second side support, the upper member extending at least partially towards a front of the treadmill and including a curve to couple to each of the first and second side supports;

a lower front member coupled vertically below the upper member to the first side and the second side support, the lower front member extending at least partially towards a front of the treadmill and including a top member to couple each of the first and second side supports;

a first lower rear member coupled to the first side support and extending at least partially towards the rear of the treadmill; and a second lower rear member coupled to the second side support and extending at least partially towards the rear of the treadmill.

8. The handrail assembly of claim 7, wherein each of the first and second lower rear members extend at least partly vertically upwards such that the first lower rear member and the second lower rear member couple to the upper member.

9. The handrail assembly of claim 7, wherein the upper member, the first side support, and the first lower rear member define a first space, wherein the upper member, the lower front member and the top member define a second space, and wherein the upper member, the second side support, and the second lower rear member define a third space.

10. The handrail assembly of claim 7, wherein the upper member and the lower front member extend vertically upward and away from the first side support.

11. The handrail assembly of claim 10, wherein the upper member, the first side support, and the lower front member define a fourth space, and wherein the upper member, the second side support, and the front lower member define a fifth space.

12. The handrail assembly of claim 7, wherein the upper member includes an end portion extending towards a rear end of the treadmill from a coupling point of the upper member to the first lower rear member.

13. A treadmill, comprising:

a frame;

a first side support coupled to and extending substantially vertically upwards from the frame;

a second side support spaced apart from the first side support, the second side support coupled to and extending substantially vertically upwards from the frame;

a first upper member coupled to the first side support;

a first lower member coupled to the first side support, the first lower member coupled to the first side support vertically below the first upper member;

a second upper member coupled to the second side support;

a second lower member coupled to the second side support, the second lower member coupled to the second side support vertically below the second upper member;

a first push member coupled to the first lower member and extending upwards towards the first upper member;

a second push member coupled to the second lower member and extending upwards towards the second upper member;

wherein the first side support, the first upper member, the first lower member, and the first push member define a first space;

wherein the second side support, the second upper member, the second lower member, and the second push member define a second space; and wherein at least one of the first or second push members are configured to be engaged with by a user of the treadmill while performing a push exercise on the treadmill.

14. The treadmill of claim 13, further comprising:

a third push member coupled to the first lower member and extending vertically above the first upper member; and a fourth push member coupled to the second lower member and extending vertically above the first upper member.

15. The treadmill of claim 14, wherein the first side support, the first upper member, the first lower member, and the third push member define a third space, and wherein the second side support, the second upper member, the second lower member, and the fourth push member define a fourth space.

16. The treadmill of claim 14, wherein the third push member is coupled to the fourth push member via a top member disposed at least partially vertically above the first and second upper members.

17. The treadmill of claim 13, wherein the first upper member includes an upper front portion and an upper rear portion, the upper front portion extending away from the first side support toward a front end of the treadmill and the upper rear portion extending away from the first side support toward a rear end of the treadmill, wherein the upper front portion is at least partially angled upward relative to the upper rear portion.

18. The treadmill of claim 13, further comprising a display device coupled to the first and second upper members.

19. The treadmill of claim 18, wherein the first push member is coupled to the second push member via a top member disposed at least partially vertically above the display device.

20. The treadmill of claim 13, wherein at least one of the first lower member, second lower member, first upper member, second upper member, first push member, or second push member includes a sensor configured to collect data relating to a usage of the treadmill.

* * * * *